US008126708B2

(12) United States Patent
Rajendran et al.

(10) Patent No.: US 8,126,708 B2
(45) Date of Patent: Feb. 28, 2012

(54) SYSTEMS, METHODS, AND APPARATUS FOR DYNAMIC NORMALIZATION TO REDUCE LOSS IN PRECISION FOR LOW-LEVEL SIGNALS

(75) Inventors: Vivek Rajendran, San Diego, CA (US); Ananthapadmanabhan A. Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1017 days.

(21) Appl. No.: 12/023,030

(22) Filed: Jan. 30, 2008

(65) Prior Publication Data

US 2008/0162126 A1 Jul. 3, 2008

Related U.S. Application Data

(63) Continuation-in-part of application No. 11/669,407, filed on Jan. 31, 2007.

(60) Provisional application No. 60/868,476, filed on Dec. 4, 2006.

(51) Int. Cl.
*G10L 19/14* (2006.01)

(52) U.S. Cl. ..... 704/224; 704/225; 704/230

(58) Field of Classification Search ..... None
See application file for complete search history.

(56) References Cited

U.S. PATENT DOCUMENTS 4,901,307 A 2/1990 Gilhousen et al.

(Continued)

FOREIGN PATENT DOCUMENTS

EP 1094401 4/2001

(Continued)

OTHER PUBLICATIONS

Tremain, T. et al., "A 4.8 KBPS Code Excited Linear Predictive Coder," Proceedings of the Mobile Satellite Conference, 1988, pp. 491-496.

(Continued)

*Primary Examiner* — Talivaldis Ivars Smits
(74) *Attorney, Agent, or Firm* — Todd Marlette; Heejong Yoo

(57) ABSTRACT

A dynamic normalization factor for a current frame of a signal is determined to reduce loss in precision for low-level signals. The normalization factor depends on an amplitude of the current frame of the signal. The normalization factor also depends on values of filter states after one or more operations were performed on a previous frame of a normalized signal and on the normalization factor for the previous frame. The current frame of the signal is normalized based on the normalization factor that is determined. The states' normalization factor may be adjusted based on the normalization factor that is determined.

53 Claims, 9 Drawing Sheets

U.S. PATENT DOCUMENTS

| | | | | |
|---|---|---|---|---|
| 5,068,899 | A | 11/1991 | Ellis et al. | |
| 5,103,459 | A | 4/1992 | Gilhousen et al. | |
| 5,487,022 | A | 1/1996 | Simpson et al. | |
| 5,570,454 | A | 10/1996 | Liu | |
| 5,699,484 | A | 12/1997 | Davis | |
| 5,774,838 | A | 6/1998 | Miseki et al. | |
| 5,915,235 | A * | 6/1999 | DeJaco et al. | 704/234 |
| 6,088,445 | A | 7/2000 | Chadha et al. | |
| 6,308,155 | B1 | 10/2001 | Kingsbury et al. | |
| 6,456,964 | B2 | 9/2002 | Manjunath et al. | |
| 6,681,202 | B1 | 1/2004 | Miet et al. | |
| 6,711,598 | B1 | 3/2004 | Pare, Jr. et al. | |
| 6,732,070 | B1 | 5/2004 | Rotola-Pukkila et al. | |
| 7,031,269 | B2 | 4/2006 | Lee | |
| 7,062,525 | B1 | 6/2006 | Lin | |
| 7,089,184 | B2 | 8/2006 | Rorex | |
| 7,596,492 | B2 * | 9/2009 | Sung et al. | 704/223 |
| 7,657,428 | B2 | 2/2010 | Haberman et al. | |
| 2003/0036901 | A1 * | 2/2003 | Chen | 704/230 |
| 2003/0088405 | A1 | 5/2003 | Chen et al. | |
| 2005/0004793 | A1 | 1/2005 | Ojala et al. | |
| 2008/0126086 | A1 * | 5/2008 | Vos et al. | 704/225 |

FOREIGN PATENT DOCUMENTS

| | | | |
|---|---|---|---|
| EP | 1498873 | A1 | 1/2005 |
| EP | 1515310 | | 3/2005 |
| RU | 2233010 | | 7/2004 |
| WO | WO0156021 | A1 | 8/2001 |

OTHER PUBLICATIONS

European Telecommunications Standards Institute ("ETSI"), Universal Mobile Telecommunications System (UMTS); Mandatory Speech Codec speech processing functions AMR speech codec; Transcoding functions (3G TS 26.090 version 3.1.0 Release 1999), ETSI TS 126 090 V3.1.0 (Jan. 2000), pp. 1-62.

3rd Generation Partnership Project 2 ("3GPP2"), "Enhanced Variable Rate Codec, Speech Service Options 3, 68, and 70 for Wideband Spread Spectrum Digital Systems," 3GPP2 C.S0014-C, Version 1.0, Jan. 2007, ch. 4, pp. 4-1 to 4-181.

3rd Generation Partnership Project 2 ("3GPP2"), "Enhanced Variable Rate Codec, Speech Service Options 3, 68, and 70 for Wideband Spread Spectrum Digital Systems," 3GPP2 C.S0014-C, Version 1.0, Jan. 2007, ch. 5, pp. 5-1 to 5-42.

3rd Generation Partnership Project 2 ("3GPP2"), "Enhanced Variable Rate Codec, Speech Service Option 3 and 68 for Wideband Spread Spectrum Digital Systems," 3GPP2 C.S0014-B, Version 1.0, May 2006, ch. 4.1 to 4.5, pp. 4-1 to 4-45.

3rd Generation Partnership Project 2 ("3GPP2"), "Enhanced Variable Rate Codec, Speech Service Option 3 and 68 for Wideband Spread Spectrum Digital Systems," 3GPP2 C.S0014-B, Version 1.0, May 2006, ch. 4.6 to 4.9.8.4, pp. 4-45 to 4-99.

3rd Generation Partnership Project 2 ("3GPP2"), "Enhanced Variable Rate Codec, Speech Service Option 3 and 68 for Wideband Spread Spectrum Digital Systems," 3GPP2 C.S0014-B, Version 1.0, May 2006, ch. 4.9.8.5 to 4.16.2, pp. 4-99 to 4-147.

3rd Generation Partnership Project 2 ("3GPP2"), "Enhanced Variable Rate Codec, Speech Service Option 3 and 68 for Wideband Spread Spectrum Digital Systems," 3GPP2 C.S0014-B, Version 1.0, May 2006, ch. 5, pp. 5-1 to 5-32.

Ashley, J.P. and Mittal, U., Closed Loop Dynamic Bit Allocation for Excitation Parameters in Analysis-by-Synthesis Speech Codec, IEEE International Conference on Acoustics, Speech and Signal Processing, 2007 ("ICASSP 2007"), vol. 4, Apr. 15-20, 2007, pp. IV-1109-IV-1112.

Ashley, J.P., et al., "Wideband Coding of Speech Using a Scalable Pulse Codebook," 2000 IEEE Workshop on Speech Coding, 2000, Sep. 17-20, 2000, pp. 148-150.

B.S. Atal and M.R. Schroeder, "Stochastic Coding of Speech Signals at Very Low Bit Rates," Links for the Future; Science, Systems & Services for Communications; Proceedings of the International Conference on Communications ("ICC '84"), May 1984, Part 2, pp. 1610-1613.

Bessette, B., et al., "The Adaptive Multirate Wideband Speech Codec (AMR-WB)," IEEE Transactions on Speech and Audio Processing, vol. 10, No. 8, Nov. 2002, 620-636.

DeJaco, A. et al., "QCELP: The North American CDMA Digital Cellular Variable Rate Speech Coding Standard," IEEE Workshop on Speech Coding for Telecommunications, Oct. 13-15, 1993, pp. 5-6.

Kleijn, W.B. et al., "Fast Methods for the CELP Speech Coding Algorithm," IEEE Transactions on Acoustics, Speech, and Signal Processing [see also IEEE Transactions on Signal Processing], vol. 38, No. 8, Aug. 1990, pp. 1330-1342.

Kleijn, W.B., et al., "The RCELP Speech-Coding Algorithm," European Transaction on Telecommunications and Related Technologies, vol. 5, No. 5, Sep.-Oct. 1994, pp. 573-582.

Kubin, G. et al., "Performance of Noise Excitation for Unvoiced Speech," IEEE Workshop on Speech Coding for Telecommunications, Oct. 13-15, 1993, pp. 35-36.

Laflamme, C., et al., "16 kbps Wideband Speech Coding Technique Based on Algebraic CELP," 1991 International Conference on Acoustics, Speech, and Signal Processing, 1991 ("ICASSP-91"), vol. 1, Apr. 14-17, 1991, pp. 13-16.

Nahumi, D. and Kleijn, W.B., "An Improved 8 KB/S RCELP Coder," 1995 IEEE Workshop on Speech Coding for Telecommunications, Sep. 20-22, 1995, pp. 39-40.

Rabiner, L.R. et al., "Digital Processing of Speech Signals," Prentice Hall, Inc., Englewood, N.J., ch. 8, "Linear Predictive Coding of Speech," 1978, pp. 396-455.

Salami, R., et al., A Toll Quality 8 kb/s Speech Codec for the Personal Communications system (PCS), IEEE Transactions on Vehicular Technology, vol. 43, No. 3, Part 1-2, Aug. 1994, 808-816.

Schroeder, M., et al., "Code-excited linear prediction (CELP): High-quality speech at very low bit rates," IEEE International Conference on Acoustics, Speech, and Signal Processing ("ICASSP '85"), vol. 10, Apr. 1985, pp. 937-940.

So, S., et al., "A Comparative Study of LPC Parameter Representations and Quantisation Schemes for Wideband Speech Coding," Digital Signal Processing 17, 2007 (Available online Nov. 8, 2005), pp. 114-137.

Yasukawa, H., "Restoration of Wide Band Signal from Telephone Speech Using Linear Prediction Error Processing," Fourth International Conference on Spoken Language ("ICSLP 96"), vol. 2, Oct. 3-6, 1996, pp. 901-904.

International Search Report—PCT/US07/086076—International Search Authority, European Patent Office—Jul. 8, 2008.

Written Opinion—PCT/US07/086076—International Search Authority, European Patent Office—Jul. 8, 2008.

Chakraborty M., et al. "An efficient block floating point implementation of the LMS algorithm," 2003 IEEE International Conference on Acoustics, Speech, and Signal Processing, Hong Kong, vol. 6, Apr. 6, 2003, pp. VI_77-VI_80.

Oppenheim A.V., "Realization of digital filters using block-floating-point arithmetic," IEEE Transactions on Audio and Electroacoustics, col. AU-18, No. 2, Jun. 1, 1970, pp. 130-136.

Sridharan S., et al., "Block floating-point Implementation of digital filters using the DSP56000," Microprocessors and microsystems, IPC Business Press Ltd., London, GB, vol. 12, No. 6 Jul. 1, 1988, pp. 299-308.

International Preliminary Report on Patentability—PCT/US07/686076, International Search Authority—European Patent Office, Feb. 2, 2009.

3rd Generation Partnership Project 2 ("3GPP2"), "Enhanced Variable Rate Codec, Speech Service Options 3, 68, and 70 for Wideband Spread Spectrum Digital Systems," 3GPP2 C.50014-C, Version 0.3, Jul. 2006, §§ 4.5, 4.18.3, 5.2.3.15, 5.13, pp. 4-35 to 4-37; 4-163 to 4-165; 5-14; 5-39 to 5-40.

* cited by examiner

SYSTEMS, METHODS, AND APPARATUS FOR DYNAMIC NORMALIZATION TO REDUCE LOSS IN PRECISION FOR LOW-LEVEL SIGNALS

RELATED APPLICATIONS

This patent application is a continuation-in-part of U.S. patent application Ser. No. 11/669,407 entitled "SYSTEMS AND METHODS FOR DYNAMIC NORMALIZATION TO REDUCE LOSS IN PRECISION FOR LOW-LEVEL SIGNALS", filed on Jan. 31, 2007, which claims priority to U.S. Provisional Application No. 60/868,476 entitled "DYNAMIC NORMALIZATION TO REDUCE LOSS IN PRECISION FOR LOW-LEVEL SIGNALS" filed Dec. 4, 2006, which are both assigned to the assignee hereof and are hereby expressly incorporated by reference herein.

TECHNICAL FIELD

The present disclosure relates generally to signal processing technology. More specifically, the present disclosure relates to systems, methods, and apparatus for dynamic normalization to reduce loss in precision for low-level signals.

BACKGROUND

Various over-the-air interfaces have been developed for wireless communication systems including, e.g., Frequency Division Multiple Access ("FDMA"), Time Division Multiple Access ("TDMA"), Code Division Multiple Access ("CDMA"), and Orthogonal Frequency Division Multiple Access ("OFDMA"). In connection therewith, various domestic and international standards have been established including, e.g., Advanced Mobile Phone Service ("AMPS"), Global System for Mobile Communications ("GSM"), and Interim Standard 95 ("IS-95").

An exemplary wireless telephony communication system is a Code Division Multiple Access ("CDMA") system. The IS-95 standard and its derivatives, IS-95A, ANSI J-STD-008, IS-95B, and third generation standards IS-95C and IS-2000, etc. (referred to collectively herein as IS-95), are promulgated by the Telecommunication Industry Association (TIA). Other well known standards bodies, such as The 3rd Generation Partnership Project 2 ("3GPP2"), specify the use of a CDMA over-the-air interface for cellular or PCS telephony communication systems. Exemplary wireless communication systems configured substantially in accordance with the use of the IS-95 standard are described in U.S. Pat. Nos. 5,103,459 and 4,901,307, which are assigned to the assignee of the present invention and fully incorporated herein by reference.

Multimedia streams may include speech, and may be from one or more sources that communicate with or are otherwise associated with a broadcast system. The broadcast system can use, without limitation, CDMA principles, GSM principles, or other wireless principles including wideband CDMA (WCDMA), cdma2000 (such as cdma2000 1x or 3x air interface standards, for example), TDMA, or TD-SCDMA, and OFDM. The multimedia content, including speech, can alternatively be provided, for example, over a bidirectional point-to-point link if desired, such as, e.g., a Bluetooth link or a 802.11 link or a CDMA link or GSM link. Likewise, speech content may also be transmitted using a Voice Over Internet Protocol ("VoIP"). VoIP is a protocol optimized for the transmission of voice through the Internet or other packet switched networks, which may interface with and/or merge with CDMA and GSM based systems.

Transmission of voice by digital techniques has become widespread, particularly in long distance and digital air-interface radio telephone applications. This, in turn, has created interest in determining the least amount of information which can be sent over the channel while maintaining the perceived quality of the reconstructed speech. If speech is transmitted by simply sampling and digitizing, a data rate on the order of 64 kilobits per second (kbps) is required to achieve a quality, known as "toll quality," of a conventional analog telephone. However, through the use of speech analysis, followed by the appropriate coding, transmission, and resynthesis at the receiver, a significant reduction in the data rate can be achieved.

Devices which employ techniques to compress voiced speech by extracting parameters that relate to a model of human speech generation are typically called vocoders. Such devices are composed of an encoder, which analyzes the incoming speech to extract the relevant parameters, and a decoder, which resynthesizes the speech using the parameters which it receives over the transmission channel. In order to enhance quality, the speech codec model adapts to the changing speech signal. Modern vocoders typically operate on a digitized input signal that has been divided into blocks of time called analysis frames. Parameters are then extracted corresponding to the analysis frames.

Of the various classes of coders the Code Excited Linear Predictive Coding ("CELP"), Stochastic Coding or Vector Excited Speech Coding are of one class. An example of a coding algorithm of this particular class is described in the paper "A 4.8 kbps Code Excited Linear Predictive Coder" by Thomas E. Tremain et al., Proceedings of the Mobile Satellite Conference, 1988. Modern vocoders typically operate at variable rates, and are defined by standards. While various types of vocoders exist, modern commercial telecommunications vocoders generally fall into two general classes, namely the CDMA type and the GSM type.

A modern CDMA type network speech codec is known as Enhanced Variable Rate CODEC ("EVRC"). A version of EVRC is defined by The Telecommunications Industry Association as IS-127-B, and is formally entitled "Enhanced Variable Rate Codec Speech Service Option 3 and YY for Wideband Spread Spectrum Digital Systems," dated December 2006. A modern GSM type of network speech codec is known as Adaptive Multi-Rate ("AMR"). A version of AMR is defined by The 3rd Generation Partnership Project ("3GPP") as 3G TS 26.090, version 3.1.0, release 1999, and is formally entitled "Universal Mobile Telecommunications System ("UMTS"); Mandatory Speech Codec speech processing functions AMR speech codec; Transcoding functions," dated January 2000.

Modern Second Generation ("2G") and Third Generation ("3G") radio telephone communication systems have sought to produce voice quality commensurate with the conventional public switched telephone network ("PSTN"). The PSTN have traditionally been limited in bandwidth to the frequency range of 300-3400 kHz. New networks for voice communications, such as cellular telephony and Voice over IP ("VoIP"), are not necessarily constrained by the same bandwidth limits. Accordingly, it may be desirable to transmit and receive voice communications that include a wideband frequency range over such networks. For example, it may be desirable to support an audio frequency range that extends down to 50 Hz and/or up to 7 or 8 kHz. It may also be desirable to support other applications, such as high-quality audio or audio/video conferencing, that may have audio speech content in ranges outside the traditional PSTN limits. Codecs which seek to extend the audio frequency range as set forth above are commonly referred to as wideband codecs.

Extension of the range supported by a speech coder into higher frequencies may improve intelligibility. For example, the information that differentiates fricatives such as 's' and 'f' is largely in the high frequencies. Highband extension may also improve other qualities of speech, such as presence. For example, even a voiced vowel may have spectral energy far above the PSTN limit.

The term signal processing may refer to the processing and interpretation of signals. Signals of interest may include sound, images, and many others. Processing of such signals may include storage and reconstruction, separation of information from noise, compression, and feature extraction. The term digital signal processing may refer to the study of signals in a digital representation and the processing methods of these signals. Digital signal processing is an element of many communications technologies such as mobile phones and the Internet. The algorithms that are utilized for digital signal processing may be performed using specialized computers, which may make use of specialized microprocessors called digital signal processors (sometimes abbreviated as DSPs).

DETAILED DESCRIPTION

Figure 1:
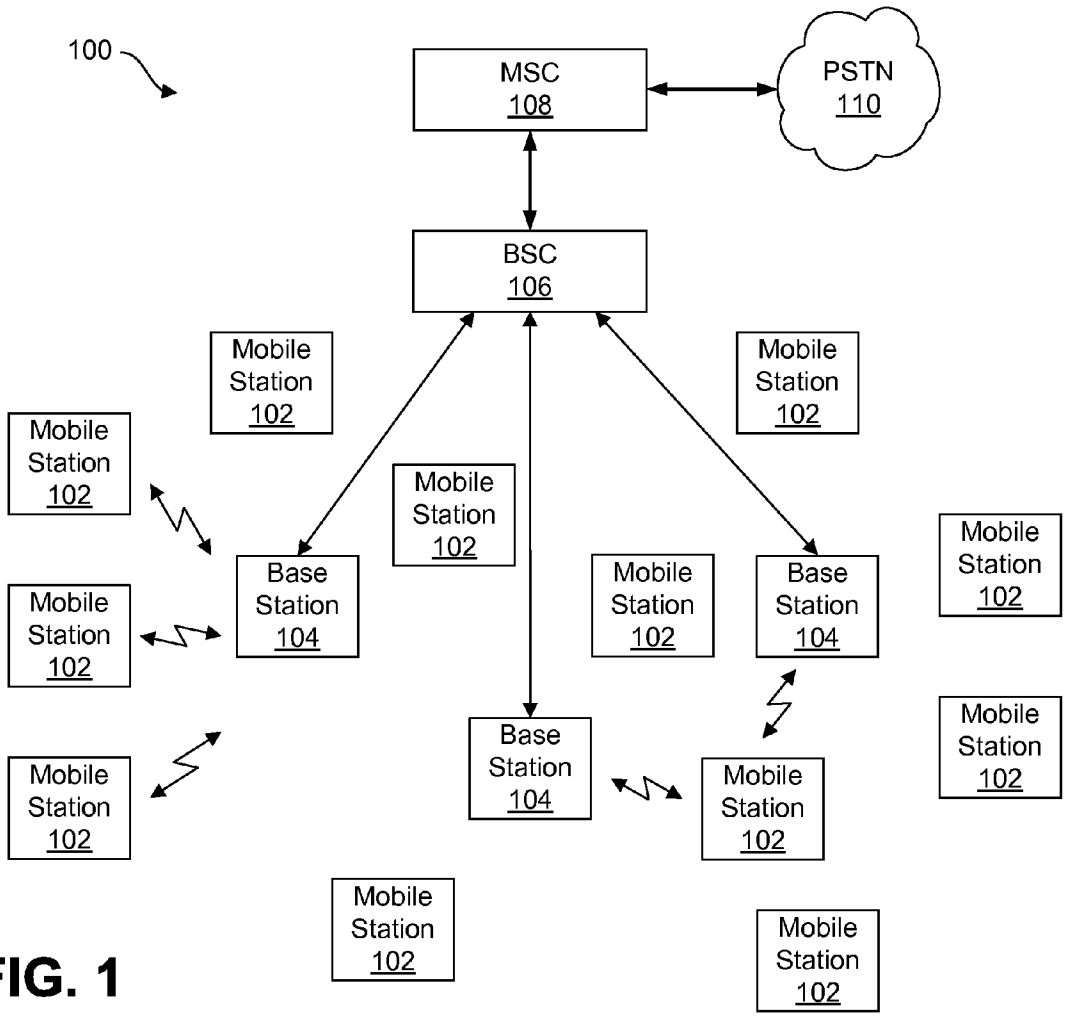
FIG. 1 illustrates a wireless communication system.

An apparatus that is configured for dynamic normalization to reduce loss in precision for low-level signals is described. The apparatus includes a processor and memory in electronic communication with the processor. Instructions are stored in the memory. The instructions are executable to determine a normalization factor for a current frame of a signal. The normalization factor depends on an amplitude of the current frame of the signal. The normalization factor also depends on non-linear values of states after one or more operations were performed on a previous frame of a normalized signal. The instructions are also executable to normalize the current frame of the signal based on the normalization factor that is determined, and adjust the states' normalization factor based on the normalization factor that is determined.

A method for dynamic normalization to reduce loss in precision for low-level signals is also described. A normalization factor is determined for a current frame of a signal. The normalization factor depends on an amplitude of the current frame of the signal. The normalization factor also depends on non-linear values of states after one or more operations were performed on a previous frame of a normalized signal. The current frame of the signal is normalized based on the normalization factor that is determined. The states' normalization factor is adjusted based on the normalization factor that is determined.

An apparatus that is configured for dynamic normalization to reduce loss in precision for low-level signals is also described. The apparatus includes means for determining a normalization factor for a current frame of a signal. The normalization factor depends on an amplitude of the current frame of the signal. The normalization factor also depends on non-linear values of states after one or more operations were performed on a previous frame of a normalized signal. The apparatus also includes means for normalizing the current frame of the signal based on the normalization factor that is determined, and means for adjusting the states' normalization factor based on the normalization factor that is determined.

A computer-readable medium configured to store a set of instructions is also described. The instructions are executable to determine a normalization factor for a current frame of a signal. The normalization factor depends on an amplitude of the current frame of the signal. The normalization factor also depends on non-linear values of states after one or more operations were performed on a previous frame of a normalized signal. The instructions are also executable to normalize the current frame of the signal based on the normalization factor that is determined, and adjust the states' normalization factor based on the normalization factor that is determined.

An apparatus that is configured for dynamic normalization to reduce loss in precision for low-level signals is described. The apparatus includes a processor and memory in electronic communication with the processor. Instructions are stored in the memory. The instructions are executable to determine a first gain of a first frame. The first frame is a current frame. The instructions are also executable to determine a second gain of a second frame. The second frame is a previous frame. The instructions are further executable to derive a number of bits corresponding to the first gain and the second gain, and subtract the number of bits corresponding to the first gain and the second gain from a normalization factor associated with the first frame. The normalization factor depends on an amplitude of the current frame of the signal. The normalization factor also depends on non-linear values of states after one or more operations were performed on a previous frame of a normalized signal.

A method for dynamic normalization to reduce loss in precision for low-level signals is also described. A first gain of a first frame is determined. The first frame is a current frame. A second gain of a second frame is determined. The second frame is a previous frame. A number of bits corresponding to the first gain and the second gain is derived. The number of bits corresponding to the first gain and the second gain is subtracted from a normalization factor associated with the first frame. The normalization factor depends on an amplitude of the current frame of the signal. The normalization factor also depends on non-linear values of states after one or more operations were performed on a previous frame of a normalized signal.

An apparatus that is configured for dynamic normalization to reduce loss in precision for low-level signals is described. The apparatus includes means for determining a first gain of a first frame. The first frame is a current frame. The apparatus also includes means for determining a second gain of a second frame. The second frame is a previous frame. The apparatus further includes means for deriving a number of bits corresponding to the first gain and the second gain, and means for subtracting the number of bits corresponding to the first gain and the second gain from a normalization factor associated with the first frame. The normalization factor depends on an amplitude of the current frame of the signal. The normalization factor also depends on non-linear values of states after one or more operations were performed on a previous frame of a normalized signal.

A computer-readable medium configured to store a set of instructions is also described. The instructions are executable to determine a first gain of a first frame. The first frame is a current frame. The instructions are also executable to determine a second gain of a second frame. The second frame is a previous frame. The instructions are further executable to derive a number of bits corresponding to the first gain and the second gain, subtract the number of bits corresponding to the first gain and the second gain from a normalization factor associated with the first frame. The normalization factor depends on an amplitude of the current frame of the signal. The normalization factor also depends on non-linear values of states after one or more operations were performed on a previous frame of a normalized signal.

As used herein, the term "determining" (and grammatical variants thereof) is used in an extremely broad sense. The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

FIG. 1 illustrates a wireless communication system 100 that may include a plurality of mobile stations 102, a plurality of base stations 104, a base station controller (BSC) 106 and a mobile switching center (MSC) 108. The MSC 108 may be configured to interface with a public switched telephone network (PSTN) 110. The MSC 108 may also be configured to interface with the BSC 106. There may be more than one BSC 106 in the system 100. The mobile stations 102 may include cellular or portable communication system (PCS) telephones.

Each base station 104 may include at least one sector (not shown), where each sector may have an omnidirectional antenna or an antenna pointed in a particular direction radially away from the base station 104. Alternatively, each sector may include two antennas for diversity reception. Each base station 104 may be designed to support a plurality of frequency assignments. The wireless communication system 100 may be configured to implement code-division multiple access (CDMA) techniques. In a CDMA system 100, the intersection of a sector and a frequency assignment may be referred to as a CDMA channel.

During operation of the wireless communication system 100, the base stations 104 may receive sets of reverse link signals from sets of mobile stations 102. The mobile stations 102 may be conducting telephone calls or other communications. Each reverse link signal received by a given base station 104 may be processed within that base station 104. The resulting data may be forwarded to the BSC 106. The BSC 106 may provide call resource allocation and mobility management functionality including the orchestration of soft handoffs between base stations 104. The BSC 106 may also route the received data to the MSC 108, which may provide additional routing services for interfacing with the PSTN 110. Similarly, the PSTN 110 may interface with the MSC 108, and the MSC 108 may interface with the BSC 106, which in turn may control the base stations 104 to transmit sets of forward link signals to sets of mobile stations 102.

For purposes of example, certain systems, methods and apparatus will be described in relation to speech signals that may be processed by a wideband vocoder. (The term "wideband vocoder" will be discussed in greater detail below.) However, the systems methods, and apparatus disclosed herein are applicable outside the context of speech signals. In fact, the systems, methods, and apparatus disclosed herein may be used in connection with the processing of any type of signal (e.g., music, video, etc.) in finite precision.

The discussion that follows includes references to filter states. However, the systems, methods and apparatus disclosed herein are applicable to other types of states. Also, the term "states" should be construed broadly to mean any configuration of information or memories in a program or machine.

Transmission of voice by digital techniques has become widespread, particularly in long distance and digital radio telephone applications. In the past, voice communications have been limited in bandwidth to the frequency range of 300-3400 kHz. New networks for voice communications, such as cellular telephony and voice over IP, may not have the same bandwidth limits, and it may be desirable to transmit and receive voice communications that include a wideband frequency range over such networks.

A voice coder, or "vocoder," is a device that facilitates the transmission of compressed speech signals across a communication channel. A vocoder may comprise an encoder and a decoder. An incoming speech signal may be divided into blocks of time, or analysis frames. The encoder may analyze an incoming speech frame to extract certain relevant parameters, and then quantize the parameters into a binary representation. The binary representation may be packed into transmission frames and transmitted over a communication channel to a receiver with a decoder. The decoder may process the transmission frames, dequantize them to produce the parameters, and resynthesize the speech frames using the dequantized parameters. The encoding and decoding of speech signals may be performed by digital signal processors (DSPs) running a vocoder. Because of the nature of some voice communication applications, the encoding and decoding of speech signals may be performed in real time.

A device (e.g., a mobile station 102 or a base station 104) that is deployed in a wireless communication system 100 may include a wideband vocoder, i.e., a vocoder that is configured to support a wideband frequency range. A wideband vocoder may comprise a wideband encoder and a wideband decoder.

Figure 2:
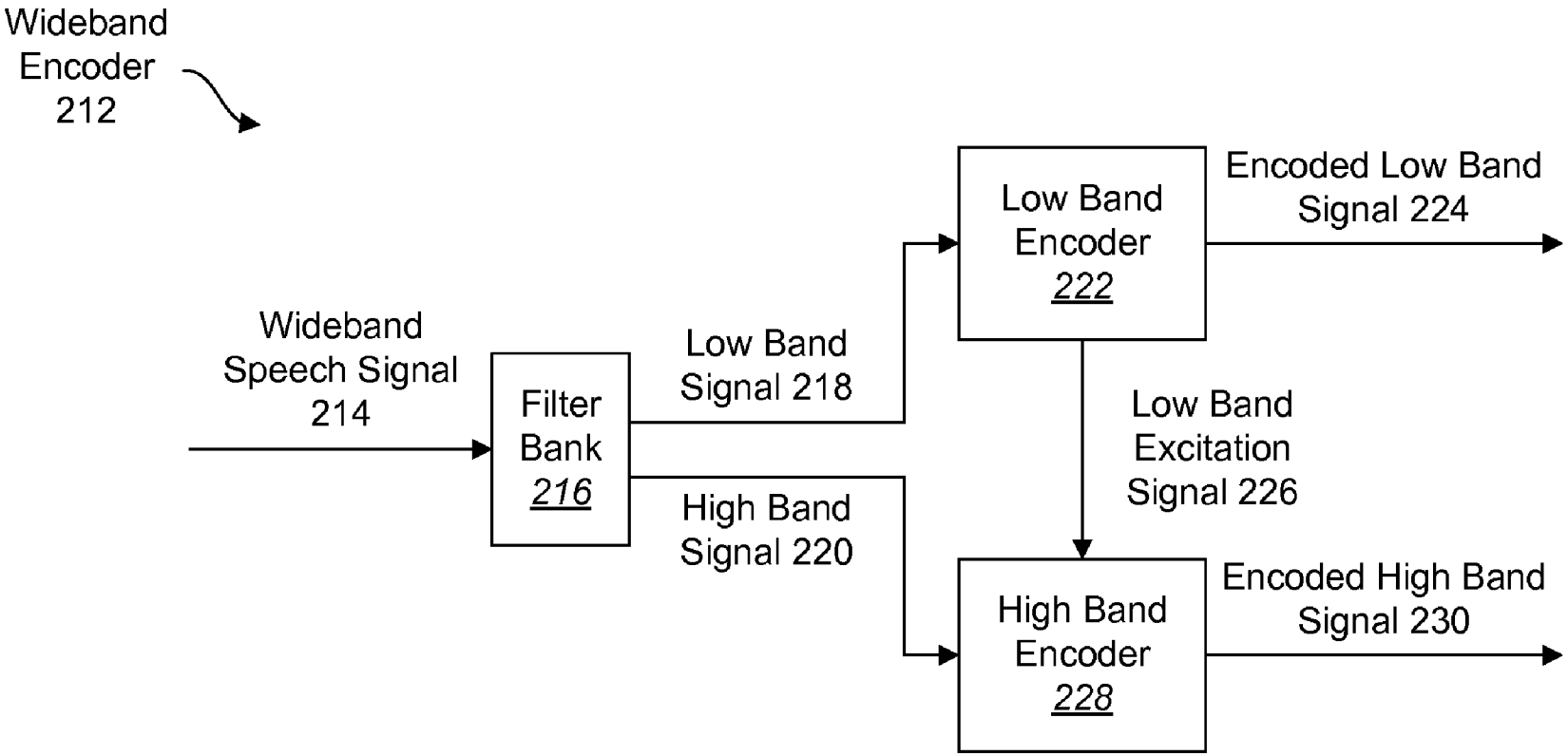
FIG. 2 illustrates a wideband encoder that may be utilized in a wireless communication system.

FIG. 2 illustrates a wideband encoder 212. The wideband encoder 212 may be implemented in an apparatus that may be utilized within a wireless communication system 100. The apparatus may be a mobile phone, a personal digital assistant (PDA), a laptop computer, a digital camera, a music player, a game device, or any other device with a processor. The apparatus may function as a mobile station 102 or a base station 104 within a wireless communication system 100.

A wideband speech signal 214 may be provided to the wideband encoder 212. The wideband encoder 212 may include an analysis filter bank 216. The filter bank 216 may filter the wideband speech signal 214 to produce a low band signal 218 and a high band signal 220.

The low band signal 218 may be provided to a low band encoder 222. The low band encoder 222 may encode the low band signal 218, thereby generating an encoded low band signal 224. The low band encoder 222 may also output a low band excitation signal 226.

The high band signal 220 may be provided to a high band encoder 228. The low band excitation signal 226 that is output by the low band encoder 222 may also be provided to the high band encoder 228. The high band encoder 228 may encode the high band signal 220 according to information in the low band excitation signal 226, thereby generating an encoded high band signal 230.

Figure 3:
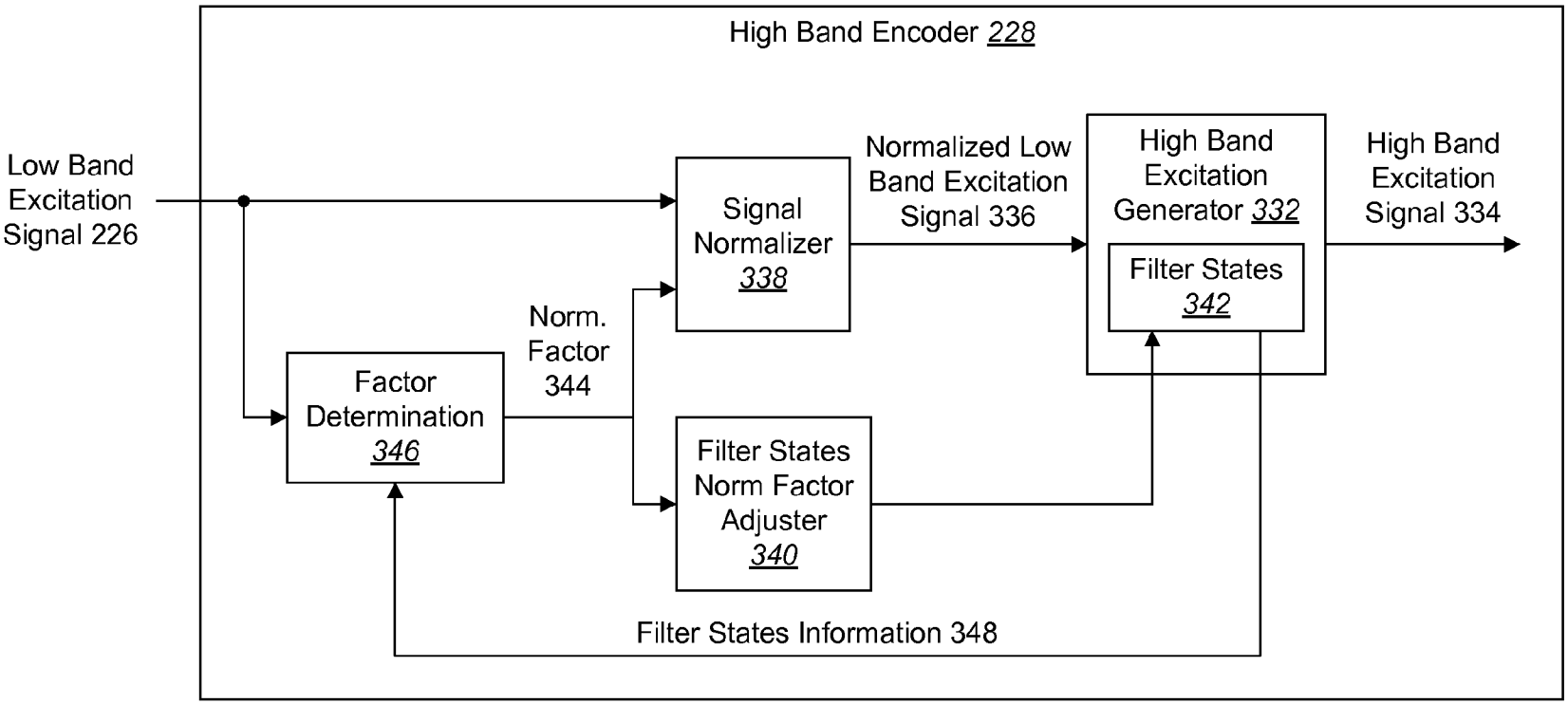
FIG. 3 illustrates a high band encoder from the wideband encoder of FIG. 2.

FIG. 3 illustrates the high band encoder 228. As discussed above, the low band excitation signal 226 may be provided to the high band encoder 228. The high band encoder 228 may include a high band excitation generator 332. The high band excitation generator 332 may derive a high band excitation signal 334 from the low band excitation signal 226.

A finite number of bits is available to represent the amplitude of the signals within the wideband encoder 212, such as the incoming wideband speech signal 214 and the low band excitation signal 226. The precision with which these signals may be represented may be directly proportional to the number of bits that are used to represent them. The term "amplitude," as used herein, may refer to any amplitude value of an array of amplitude values. For example, the term "amplitude" may refer to the maximum of the absolute values of the elements of an array of amplitude values.

The high band excitation generator 332 may perform a number of arithmetic operations on the low band excitation signal 226 (or, as will be explained below, a normalized version 336 of the low band excitation signal 226) in order to generate the high band excitation signal 334. In performing at least some of these arithmetic operations on the low band excitation signal 226, the high band excitation generator 332 may utilize the N most significant bits (MSBs) within the low band excitation signal 226. In other words, if M bits are used to represent the amplitude of the low band excitation signal 226, the high band excitation generator 332 may discard the M-N least significant bits (LSBs) within the low band excitation signal 226 and may utilize the N MSBs of the low band excitation signal 226 for the arithmetic operations that are performed.

Human speech may be classified in many different ways. Some classifications of speech may include voiced speech, unvoiced sounds, transient speech, and silence intervals/background noise during pauses between words. Under certain circumstances (e.g., for unvoiced sounds, transient speech, and silence intervals/background noise), the amplitude of the wideband speech signal 214 may be relatively low. The term low-level signal may be used herein to refer to a wideband speech signal 214 that has a relatively low amplitude. Where the incoming wideband speech signal 214 is a low-level signal, the amplitude of the low band excitation signal 226 may be fully represented, or at least mostly represented, within the LSBs of the available bits. If the LSBs are discarded by the high band excitation generator 332, then there may be a significant loss in the precision with which the low band excitation signal 226 is represented. In an extreme case, the low band excitation signal 226 may be approximated to zero by the high band excitation generator 332.

To address this issue and potentially reduce the loss of precision, the high band encoder 228 may include a signal normalizer 338. The signal normalizer 338 may normalize the low band excitation signal 226, thereby obtaining the normalized low band excitation signal 336. Additional details about the operation of the signal normalizer 338 in normalizing the low band excitation signal 226 will be discussed below.

The low band excitation signal 226 may be normalized based on a normalization factor 344. The normalization factor 344 may alternatively be referred to as a Q factor 344. The normalization factor 344 may be selected so as to prevent saturation, as will be discussed below. The component that determines the normalization factor 344 may be referred to as a factor determination component 346.

The low band excitation signal 226 may be divided into a number of frames. The term "current frame" may refer to the frame that is presently being processed by the wideband encoder 212. The term "previous frame" may refer to the frame of the low band excitation signal 226 that was processed immediately prior to the current frame.

Normalization may be performed on a frame-by-frame basis. Thus, different normalization factors 344 may be determined for different frames of the low band excitation signal 226. Because the normalization factor 344 may change over time, the type of normalization that may be performed by the signal normalizer 338 and the filter states normalization factor adjuster 340 may be referred to as dynamic normalization.

Once the normalization factor 344 for the current frame of the low band excitation signal 226 has been determined, the signal normalizer 338 may normalize the current frame of the low band excitation signal 226 based on the normalization factor 344. Normalizing the low band excitation signal 226 may comprise left-shifting the bits of the low band excitation signal 226 by an amount that corresponds to the normalization factor 344.

In some implementations, the normalization factor 344 may be negative. For example, once the normalization factor 344 is initially determined, an amount (e.g., 1) may be subtracted from the initial value of the normalization factor 344 as a protection to prevent saturation. This may be referred to as providing "head room." Where the normalization factor 344 is negative, left-shifting by a negative normalization factor 344 may be the same as right-shifting by the corresponding positive number.

Additionally, a filter states normalization factor adjuster 340 may be provided. The filter states normalization factor adjuster 340 may adjust the normalization factor of the filter states 342 based on the normalization factor 344 that is determined. Adjusting the normalization factor of the filter states 342 may comprise left-shifting the bits of the filter states 342 by an amount that corresponds to the difference between the normalization factor 344 that is determined for the current frame of the low band excitation signal 226 and the normalization factor 344 that was determined for the previous frame of the low band excitation signal 226. This operation brings the filter states 342 into the same normalization factor 344 as the normalized low band excitation signal 336, which may facilitate filtering operations being performed.

When the normalization factor 344 has been determined, the current frame of the low band excitation signal 226 has been normalized, and the normalization factor of the filter states 342 of the high band excitation generator 332 has been adjusted, the high band excitation generator 332 may derive the high band excitation signal 334 from the normalized low band excitation signal 336. This may involve performing filtering operations on the normalized low band excitation signal 336 using the adjusted filter states 342, both of which have a normalization factor 344.

The normalization factor 344 for the current frame of the low band excitation signal 226 may be selected so that saturation does not occur. There may be several ways that saturation may occur. For example, saturation may occur by left-shifting the bits of the low band excitation signal 226 to an extent where the low band excitation signal falls out of range, the range given by the number of bits used to represent the low band excitation signal. In the example discussed above, it was assumed that M bits are used to represent the low band excitation signal 226. In this case, the maximum value of the low band excitation signal 226 using 2's complement signed arithmetic may be $2^{(M-1)}-1$ and the minimum value may be $-2^{M}$. If M=16 (i.e., if 16 bits are used to represent the low band excitation signal 226), the maximum value of the low band excitation signal 226 using 2's complement signed arithmetic may be $2^{15}-1$, or 32767 and the minimum value may be $-2^{15}$, or −32768. In this situation, saturation may occur if the bits of the low band excitation signal 226 are left-shifted so that the value of the low band excitation signal 226 exceeds 32767 (for positive numbers) or becomes less than −32768 (for negative numbers). The normalization factor 344 may be determined so that this type of saturation does not occur. Thus, the normalization factor 344 may depend on the amplitude of the current frame of the low band excitation signal 226. Accordingly, the current frame of the low band excitation signal 226 may be provided to the factor determination component 346 and used to determine the normalization factor 344.

As another example, saturation may occur by left-shifting the bits of the filter states 342 of the high band excitation generator 332 to an extent where the filter states fall out of range. As discussed in the example above, if M=16, this range is given by the set of numbers which fall into the category of numbers no greater than +32767 and no less than −32768. The normalization factor 344 may be determined so that this does not occur. When the normalization factor of the filter states 342 is adjusted, the values of the filter states 342 may depend on the filtering operations that were performed on the previous frame of the normalized low band excitation signal 336. Thus, the normalization factor 344 may depend on the values of the filter states 342 after the filtering operations were performed on the previous frame of the normalized low band excitation signal 336. Accordingly, information 348 about the values of the filter states 342 after the filtering operations were performed on the previous frame of the normalized low band excitation signal 336 may be provided to the factor determination component 346 and used to determine the normalization factor 344.

Each frame of the low band excitation signal 226 may be normalized in the manner described above. More specifically, for each frame of the low band excitation signal 226, a normalization factor 344 may be determined. The current frame of the low band excitation signal 226 may be normalized based on the normalization factor 344 that is determined for that frame. Also, the normalization factor of the filter states 342 may be adjusted based on the normalization factor 344 that is determined for that frame. These steps (i.e., determining the normalization factor 344, normalizing the current frame of the low band excitation signal 226, and adjusting the normalization factor of the filter states 342) may be performed for each frame of the low band excitation signal 226.

Figure 4:
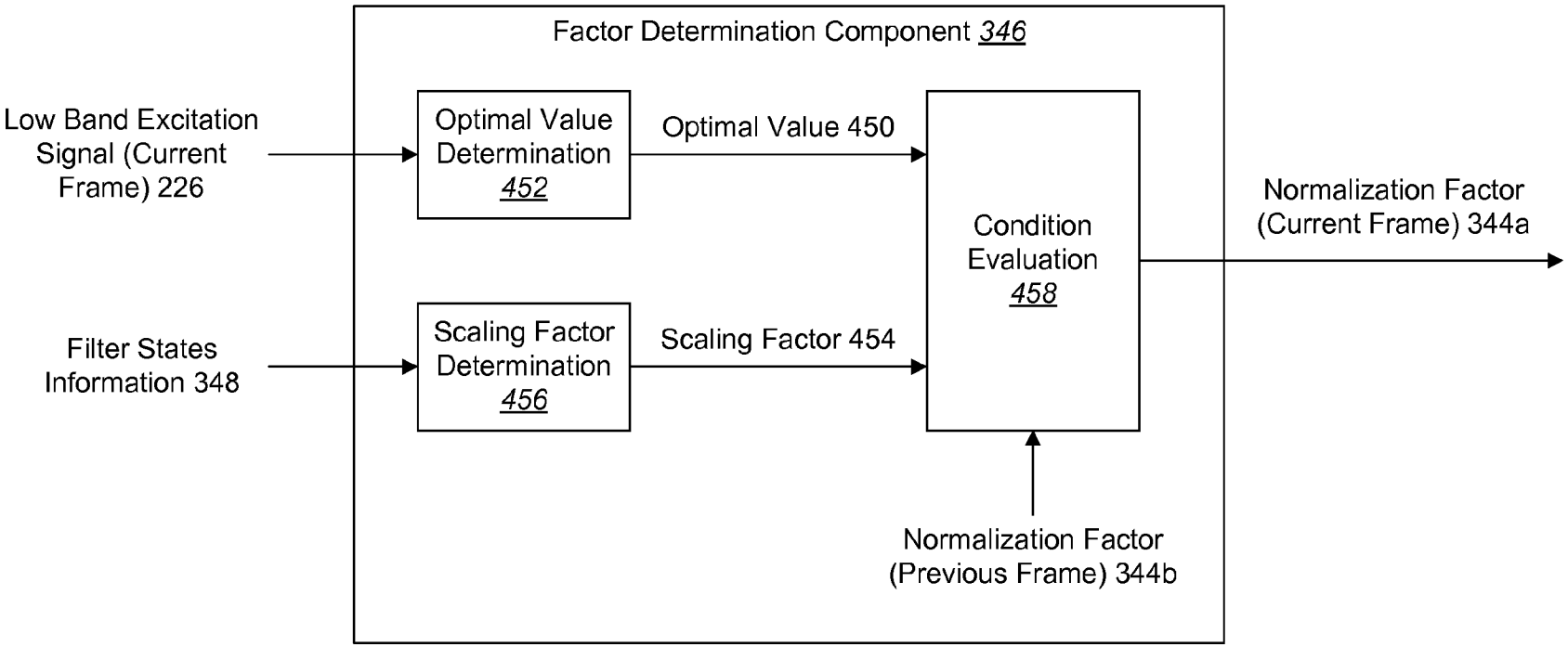
FIG. 4 illustrates a factor determination component from the high band encoder of FIG. 3.

FIG. 4 illustrates the factor determination component 346. As discussed above, the factor determination component 346 may determine the normalization factor 344*a* for the current frame of the low band excitation signal 226.

As discussed above, the current frame of the low band excitation signal 226 may be provided to the factor determination component 346. The current frame of the low band excitation signal 226 may be analyzed to determine an optimal value for the normalization factor 344*a* for the current frame of the low band excitation signal 226. (The optimal value is labeled with reference number 450 in FIG. 4, and will be referred to as optimal value 450 hereinafter.) The component that implements this functionality may be referred to as an optimal value determination component 452.

The optimal value 450 for the normalization factor 344 may be determined based on the amplitude of the current frame of the low band excitation signal 226. Since the low band excitation signal 226 of the current frame comprises an array of numbers, the optimal value 450 of the normalization factor 344 may refer to the number of bits of the maximum of the absolute value of the array of numbers that can be left-shifted without causing saturation, also referred to as the block normalization factor. The optimal value 450 for the normalization factor 344 may indicate to what extent the bits of the current frame of the low band excitation signal 226 may be left-shifted without causing saturation.

As discussed above, information 348 about the values of the filter states 342 after the filtering operations were performed on the previous frame of the normalized low band excitation signal 336 may also be provided to the factor determination component 346. This information 348 may be used to determine a scaling factor 454 for the filter states 342 of the high band excitation generator 332. The component that implements this functionality may be referred to as a scaling factor determination component 456.

The scaling factor 454 may be determined based on the filter states information 348 that is received. The scaling factor 454 may indicate to what extent the bits of the filter states 342 may be left-shifted without causing saturation. The procedure for obtaining this scaling factor 454 may be similar to the above-mentioned procedure of determining the optimal value 450 for the normalization factor 344, the array of numbers in this case being the filter states, where the filter states may be states from different filters.

In some implementations, some filter states may be double precision (DP, 32 bits) and some filter states may be single precision (SP, 16 bits). In such implementations, the block normalization factor of the double precision filter states may be obtained. This block normalization factor may then be scaled down by a factor of two to bring it to the single precision domain. It may then be determined which is the lowest block normalization factor between this scaled down double precision block normalization factor and the block normalization factor of the single precision filter states. The lowest block normalization factor may then be outputted as the scaling factor 454. In this specific example the terms current frame normalization factor 344*a* and previous frame normalization factor 344*b* refer to the normalization factor in the single precision domain. The filter states normalization factor adjuster 340 scales up by a factor of two the difference between the normalization factor 344 that is determined for the current frame of the low band excitation signal 226 and the normalization factor 344 that was determined for the previous frame of the low band excitation signal 226, before left-shifting the bits of the double precision filter states 342.

Figure 3A:
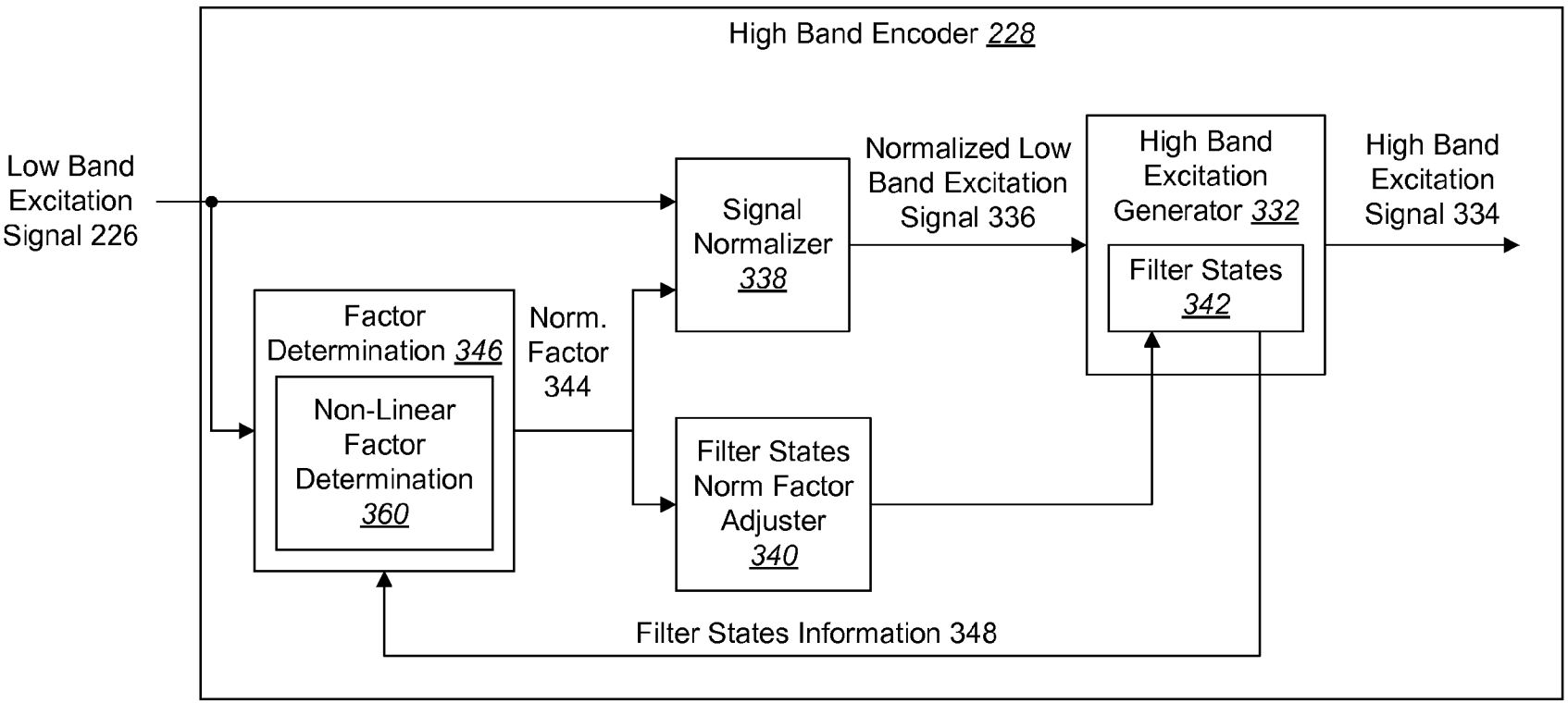
FIG. 3A illustrates another example of a high band encoder from the wideband encoder of FIG. 2.

In additional implementations, some filters may operate on the squared values of the signal and some other filters may operate directly on the signal values (in the linear domain). Hence, some filter states may be in the squared domain and some filter states may be in the linear domain. In such implementations, the block normalization factor of the squared domain filter states and the linear domain states may be obtained separately. The squared domain filter states and the linear domain filter states may not be compared directly to obtain a block normalization factor, since in some implementations, the norm factor of the squared domain filter states may be twice that of the linear domain filter states. As shown in FIG. 3A, a non-linear factor determination 360 may be implemented for non-linear filter states, such as squared values and cubic values of the signal.

The block normalization factor from the squared domain filter states may then be scaled down by a factor of two to bring it to the linear domain. It may then be determined which is the lowest block normalization factor between this scaled down squared domain block normalization factor and the block normalization factor of the linear domain filter states. The lowest block normalization factor may then be outputted as the scaling factor 454. In this example, the terms "current frame normalization factor" 344*a* and "previous frame normalization factor" 344*b* refer to the normalization factor in the linear domain. The filter states normalization factor adjuster 340 scales up by a factor of two the difference between the normalization factor 344 that is determined for the current frame of the low band excitation signal 226 and the normalization factor 344 that was determined for the previous frame of the low band excitation signal 226, before left-shifting the bits of the squared domain filter states 342.

In some implementations, the block normalization factor from the linear domain filter states may be scaled up by a factor of two to bring it to the squared domain. It may then be determined which is the lowest block normalization factor between this scaled up linear domain block normalization factor and the block normalization factor of the squared domain filter states. The lowest block normalization factor may then be outputted as the scaling factor 454. In this example, the terms "current frame normalization factor" 344*a* and "previous frame normalization factor" 344*b* refer to the normalization factor in the squared domain. The filter states normalization factor adjuster 340 scales down by a factor of two the difference between the normalization factor 344 that is determined for the current frame of the low band excitation signal 226 and the normalization factor 344 that was determined for the previous frame of the low band excitation signal 226, before left-shifting the bits of the linear domain filter states 342. In this example, if a squared domain norm factor needs to be applied to signal or filter state values in linear domain, the squared domain norm factor needs to be scaled down by a factor of two.

In an additional example, some filters may operate on the cubic values of the signal. For example, some of the filter states may be in a cube domain. A cubic spline normalization between frames may be implemented.

A saturation condition may be evaluated. The component that implements this functionality may be referred to as a condition evaluation component 458. The saturation condition may depend on the optimal value 450 for the normalization factor 344*a* for the current frame of the low band excitation signal 226. The saturation condition may also depend on the scaling factor 454 for the filter states 342 of the high band excitation generator 332.

The saturation condition may also depend on the normalization factor 344*b* for the previous frame of the low band excitation signal 226. The normalization factor 344*b* for the previous frame of the low band excitation signal 226 may indicate to what extent the bits of the previous frame of the low band excitation signal 226 were shifted prior to filtering operations being performed on the previous frame of the normalized low band excitation signal 336.

The saturation condition that is evaluated may be expressed as:

$$Qinp-\text{prev_}Qinp>Q_\text{states} \quad (1)$$

In equation (1), the term Qinp may refer to the optimal value 450 for the normalization factor 344*a* for the current frame of the low band excitation signal 226. The term prev_Qinp may refer to the normalization factor 344*b* for the previous frame of the low band excitation signal 226. The term Q_states may refer to the scaling factor 454 for the filter states 342.

If it is determined that the saturation condition is not satisfied, this may be interpreted to mean that setting the normalization factor 344*a* equal to the optimal value 450 that was determined is not going to cause saturation. In this case, determining the normalization factor 344*a* for the current frame of the low band excitation signal 226 may involve setting the normalization factor 344*a* equal to the optimal value 450 that was determined.

If it is determined that the saturation condition is satisfied, this may be interpreted to mean that setting the normalization factor 344*a* equal to the optimal value 450 that was determined is going to cause saturation. In this case, determining the normalization factor 344*a* for the current frame of the low band excitation signal 226 may involve setting the normalization factor 344*a* equal to prev_Qinp+Q_states. In this expression, the terms Qinp, prev_Qinp and Q_states may have the same meaning as was discussed above in connection with equation (1). Hence, the normalization factor 344*a* may be given by the expression MIN (Q_inp, prev_Qinp+Q_states).

The 3rd Generation Partnership Project (3GPP2) implements a standard titled "Enhanced Variable Rate Codec, Speech Service Options 3, 68, and 70 for Wideband Spread Spectrum Digital Systems." This standard may be referred to hereafter as 3GPP2 C.S0014-C. Multiple sections of the above-mentioned standard address dynamic normalization. These sections are further described below.

3GPP2 C.S0014-C, Version 0.3 Published July 2006 Section 5.2.3.15 "Synthesis of the Decoder Output Signal"

Dynamic normalization may be implemented during the synthesis of a decoder output signal. In one example, a combined excitation signal, may be filtered through a synthesis filter using interpolated LPCs. A synthesized speech signal may be created. An example of source code to implement dynamic normalization applied to the synthesis of the decoder output signal may be as follows:

```
#ifdef IMPROVE_SYN_DEC_SPCH_PRECISION
  Word40 curr_lpc_gain_fx=0;
  Word40 prev_lpc_gain_fx=0;
  Word16 n_decspch=15,lpcgain_bits,max_s16,Q_curr_bck,Q_prev_bck;
#endif
#ifdef IMPROVE_SYN_DEC_SPCH_PRECISION
    curr_lpc_gain_fx = compute_lpc_gain_fx(Llsp_fx,pci_fx,ORDER);
    prev_lpc_gain_fx = compute_lpc_gain_fx(LOldlspD_fx,pci_fx,ORDER);
    for (i=0,max_s16=0;i<FSIZE;i++)
      max_s16=MAX_FX(max_s16,abs_s(LPitchMemoryD_frame_fx[i]));
    n=norm_s(max_s16);
    Q_curr =(max_s16==0)?15:n;
    lpcgain_bits=31-23-norm32_140(MAX_FX(prev_lpc_gain_fx,curr_lpc_gain_fx));
    if ((lpcgain_bits & 1) == 1) lpcgain_bits=shr(lpcgain_bits,1)+1;
    else
```

-continued

```
    lpcgain__bits=shr(lpcgain__bits,1);
  Q__curr=sub(sub(Q__curr,lpcgain__bits),2);//2 bits space for saturation
#if 1//added this patch to prevent saturation
  find__max__decspch(&n__decspch);
  if (sub(Q__curr,Q__prev) > n__decspch) Q__curr=add(Q__prev,n__decspch); // Q__curr
lies in the interval [Q__curr,n__decspch+ Q__prev]
#endif
```

In one example, the above section of source code (and the corresponding functions it calls) may implement the factor determination 346 of FIG. 3. The following example applies the factor determination 346 to a specific configuration of when the output's dynamic range is greater than the input's dynamic range (i.e., output is amplified by a gain factor). The curr_lpc_gain_fx may be the current frame's LPC gain and prev_lpc_gain_fx may be the previous frame's LPC gain. The above code may also derive the number of bits corresponding to the LPC gain using the mapping that 1 bit equals 6 dB. In addition, the above code may subtract off the lpcgain_bits from the current frame normalization factor to provide the head room for the output and prevent saturation of the output. This may be performed in addition to the saturation prevention discussed above. A further example of the source code is as follows:

```
for (i=0;i<FSIZE;i++)
  LPitchMemoryD__frame__fx[i]=
  shl(LPitchMemoryD__frame__fx[i],Q__curr); //Q__curr
```

In one configuration, this section of code (and the corresponding functions it calls) may implement the signal normalizer 338 of FIG. 3. A further example of the source code is as follows:

```
Q__factor__adjust__decspch(Q__curr−Q__prev);
#endif
```

The above-mentioned section of the code (and the corresponding functions) may implement the filter states norm factor adjuster 340 of FIG. 3. A further example of the code is as follows:

```
#ifdef IMPROVE__SYN__DEC__SPCH__PRECISION
Q__prev=Q__curr;
#endif
#ifdef IMPROVE__SYN__DEC__SPCH__PRECISION
    for (j=0;j<FSIZE;j++)
      {
        LoutFbuf__fx[j]=shr(LoutFbuf__fx[j],Q__curr);
      }
#endif
```

The code provided above that may implement dynamic normalization applied to the synthesis of the decoder output signal calls various functions. The functions called by the above code may be as follows:

```
/* FUNCTION     : compute__lpc__gain__fx( )                                    */
/*-----------------------------------------------------------------------*/
/* PURPOSE      : Computes the LPC gain of the input LSP vector     */
/*-----------------------------------------------------------------------*/
/* INPUT ARGUMENTS :                                                          */
/*     __ (Word16 [ ]) tmplsp__fx : input signal, Q15              */
/*     __ (Word16)     order     : LPC order                          */
/*-----------------------------------------------------------------------*/
/* OUTPUT ARGUMENTS :                                                         */
/*                                                                            */
/* __ (Word40) output : lpc gain (linear) Q23                                 */
/* this scheme can compute a max LPC gain of around 48 dB        */
/*-----------------------------------------------------------------------*/
/* INPUT/OUTPUT ARGUMENTS :                                                   */
/*                                                                            */
/*                __ None                                                     */
/*-----------------------------------------------------------------------*/
/* RETURN ARGUMENTS : __ None.                                                */
/*=======================================================================
======*/
/* NOTE: Length of impulse response is fixed at 55                */
/*=======================================================================
======*/
Word40    compute__lpc__gain__fx(Word16    tmplsp__fx[ ],Word16    tmppci__fx[ ],Word16
order)
{
  //Word16 tmppci__fx[order];
  Word16 L=55;
  Word16 j;
  Word16 temp__in[L];
  Word32 temp__mem[order];
  Word40 lpc__gain1__fx=0
  lsp2lpc__fx(tmplsp__fx, tmppci__fx, tmppci__fx,order);
  temp__in[0]=0x0800; // one impulse 1.0 in Q11
```

-continued

```
  for (j=1; j<L; j++) temp__in[j]=0;
  for (j=0;j<order;j++) temp__mem[j]=0;
  synthesis__filter__fx (tmppci__fx, temp__in, H__fx, temp__mem,order, L, 3);
  /* Get energy of H */
  for (j=0,lpc__gain1__fx=0; j<L; j++)
   lpc__gain1__fx = L__mac40(lpc__gain1__fx, H__fx[j], H__fx[j]); // Q23
  return(lpc__gain1__fx);
}
void find__max__decspch(Word16 *norm)
{
   Word16 i;
   Word16 max=0;
   Word32 max32=0,temp;
   Word16 n,n1;
     if ((data__packet.Celp__Mdct__Flag==1) && (prev__celp__mdct__dec==1)) //curr and
prev are MDCT frames
     {
   max=abs__s(dec__preemphmem[0]);
   for (i=0;i<ORDER;i++) max=MAX__FX(abs__s(dec__FormantFilterMemory[i]),max);
     }
   for (i=0;i<ORDER;i++) max=MAX__FX(abs__s(FIRmempf__fx[i]),max);
   for (i=0;i<ORDER;i++)
     {
      if (SynMemory__fx[i]<0) temp=L__negate(SynMemory__fx[i]);
      else
        temp=SynMemory__fx[i];
      max32=MAX__FX(temp,max32);
     }
  for (i=0;i<ORDER;i++)
     {
      if (PF__mem__syn__pst__fx[i]<0) temp=L__negate(PF__mem__syn__pst__fx[i]);
      else
        temp=PF__mem__syn__pst__fx[i];
      max32=MAX__FX(temp,max32);
     }
   n=norm__s(max);
   n =(max==0)?15:n;
   n1=norm__1(max32);
   n1 =(max32==0)?31:n1;
   *norm = MIN__FX(n,n1);
}
void Q__factor__adjust__decspch(Word16 shl__fac)
{
  Word16 i;
  if ((data__packet.Celp__Mdct__Flag==1) && (prev__celp__mdct__dec==1)) //curr and prev
are MDCT frames
   {
  dec__preemphmem[0]=shl(dec__preemphmem[0],shl__fac);
  for(i=0;i<ORDER;i++)
dec__FormantFilterMemory[i]=shl(dec__FormantFilterMemory[i],shl__fac);
   }
  for (i=0;i<ORDER;i++) FIRmempf__fx[i]=shl(FIRmempf__fx[i],shl__fac);
   for (i=0;i<ORDER;i++)
     SynMemory__fx[i]=L__shl(SynMemory__fx[i],shl__fac);
   for (i=0;i<ORDER;i++)
     {
      PF__mem__syn__pst__fx[i]=L__shl(PF__mem__syn__pst__fx[i],shl__fac);
     }
}
```

3GPP2 C.S0014-C, Version 0.3 Published July 2006 Section 4.18.3 "High-Band Excitation Generation"

The dynamic normalization scheme may also be applied during the generation of high-band excitation signal 334 where some of the filter states are non-linear. The high-band excitation signal 334 may be derived from low-band excitation in the form of the excitation signal 226. An example of source code to implement dynamic normalization applied to the generation of high-band excitation signal 334 may be as follows:

```
    for (i=0,max__s16=0;i<LB__FRAMESIZE;i++)
          max__s16=MAX__FX(max__s16,abs__s(LB__Excitation__fx[i]));
```

-continued

```
// max__s16 has the sample with least sign bits
   n=norm__s(max__s16);
   Q__lbexct =(max__s16==0)?15:n;
   Q__lbexct=sub(Q__lbexct,1);//1 bit space for saturation
#if 1//added this patch to prevent saturation
   find__max__struc(&gen__shape__noise__dec__fx,&n__struc);
   #ifdef WMOPS__FX
   test( );
   #endif
   if (sub(Q__lbexct,prev__Q__lbexct) > n__struc)
Q__lbexct=add(prev__Q__lbexct,n__struc); // Q__lbexct
lies in the interval [Q__lbexct,n__struc+prev__Q__lbexct]
#endif
   for (i=0;i<LB__FRAMESIZE;i++)
      LB__Excitation__fx[i]= shl(LB__Excitation__fx[i],Q__lbexct);
```

-continued

```
    //Q_lbexct
  // func. which brings the Qfac of states inside
  gen_shape_noise_dec_fx struc
  // to line up with curr frame's Qfac
  Q_factor_adjust(&gen_shape_noise_dec_fx,Q_lbexct-
  prev_Q_lbexct);
prev_Q_lbexct= Q_lbexct;
```

Portions of the code provided below address non-linear filter states. Specific examples of the code which address such non-linear filter states may be as follows:

```
f->noise_iir_fx[0] = L_shl(f->noise_iir_fx[0],shl(shl_fac,1)) and
n1=norm_1(f->noise_iir_fx[0]);
  n1 =(f->noise_iir_fx[0]==0)?31:n1;
  n1=shr(n1,1);
```

The code provided above that may implement dynamic normalization applied to the generation of high-band excitation signal 334 calls various functions. The functions called by the above code may be as follows:

```
void Q_factor_adjust(struct GEN_SHP_NOISE_fx *f,Word16 shl_fac)
{
  Word16 i;
  for (i=0;i<18;i++)
    f->rapf_filt_mem_fx[i] = shl(f->rapf_filt_mem_fx[i],shl_fac);
  for (i=0;i<6;i++)
    f->gen_pulses_dec_fx->mem1_fx[i]      =      shl(f->gen_pulses_dec_fx-
>mem1_fx[i],shl_fac);
  for (i=0;i<2;i++)
    f->gen_pulses_dec_fx->rhpf_filt_mem_fx[i]      =      shl(f->gen_pulses_dec_fx-
>rhpf_filt_mem_fx[i],shl_fac);
  for (i=0;i<4;i++)
    f->res_down_dec_fx->memup_fx[i]                =      shl(f->res_down_dec_fx-
>memup_fx[i],shl_fac);
  for (i=0;i<LEN_DN_HB - 2;i++)
    f->res_down_dec_fx->state_fx[i] = shl(f->res_down_dec_fx->state_fx[i],shl_fac);
  for (i=0;i<7;i++)
    f->res_down_dec_fx->memdown_fx[i]      =      shl(f->res_down_dec_fx-
>memdown_fx[i],shl_fac);
  for (i=0;i<7;i++)
    f->memdown1_fx[i] = shl(f->memdown1_fx[i],shl_fac);
  for (i = 0; i < 4; i++)
    f->stateExc_fx[i] = shl(f->stateExc_fx[i],shl_fac);
  f->noise_iir_fx[0] = L_shl(f->noise_iir_fx[0],shl(shl_fac,1)); //in the squared domain
  for (i = 0; i < 54; i++)
    f->stateExcW_fx[i] = shl(f->stateExcW_fx[i],shl_fac);;
}
void find_max_struc(struct GEN_SHP_NOISE_fx *f,Word16 *struc_norm)
{
  Word16 i;
  Word16 max=0;
  Word16 n,n1;
  for (i=0;i<18;i++) {
    max=MAX_FX(abs_s(f->rapf_filt_mem_fx[i]),max);
  }
  for (i=0;i<6;i++) {
    max=MAX_FX(abs_s(f->gen_pulses_dec_fx->mem1_fx[i]),max);
  }
  for (i=0;i<2;i++) {
    max=MAX_FX(abs_s(f->gen_pulses_dec_fx->rhpf_filt_mem_fx[i]),max);
  }
  for (i=0;i<4;i++) {
    max=MAX_FX(abs_s(f->res_down_dec_fx->memup_fx[i]),max);
  }
  for (i=0;i<LEN_DN_HB - 2;i++) {
    max=MAX_FX(abs_s(f->res_down_dec_fx->state_fx[i]),max);
  }
#ifdef DEC_ALLPASS_STEEP_DP
  for (i=0;i<7;i++)
    f->res_down_dec_fx->memdown_fx[i]      =      L_shl(f->res_down_dec_fx-
>memdown_fx[i],shl_fac);
  for (i=0;i<7;i++)
    f->memdown1_fx[i] = L_shl(f->memdown1_fx[i],shl_fac);
#else
  for (i=0;i<7;i++) {
    max=MAX_FX(abs_s(f->res_down_dec_fx->memdown_fx[i]),max);
  }
  for (i=0;i<7;i++) {
    max=MAX_FX(abs_s(f->memdown1_fx[i]),max);
  }
#endif
  for (i = 0; i < 4; i++) {
    max=MAX_FX(abs_s(f->stateExc_fx[i]),max);
  }
```

-continued

```
  n1=norm_1(f->noise_iir_fx[0]);
  n1 =(f->noise_iir_fx[0]==0)?31:n1;
  n1=shr(n1,1); //bring from squared domain to linear domain
  for (i=0; i < 54; i++) {
    max=MAX_FX(abs_s(f->stateExcW_fx[i]),max);
  }
  n=norm_s(max);
  n =(max==0)?15:n;
  *struc_norm = sub(MIN_FX(n,n1),1); //1 bit head room
}
```

3GPP2 C.S0014-C, Version 0.3 Published July 2006 Section 4.5 "Analysis Filterbank"

Dynamic normalization may also be implemented during the high band analysis filterbank. An example of source code to implement dynamic normalization applied to the high band analysis filterbank in accordance with section 4.5 of the 3GPP2 C.S0014-C standard may be as follows:

```
#ifdef USE_NORM_FOR_ANA_HB
        Word16 Q_hbana;
        static Word16 prev_Q_hbana=0;
        Q_hbana = normalize_hb_ana
(wb_in_ptr, S_ana_hb_fx, prev_Q_hbana,
2*ibuf_len+extra_samples);
```

-continued

```
#endif
#ifdef USE_NORM_FOR_ANA_HB
        scale_hb_ana (hb_out_ptr, wb_14k_ptr,
Q_hbana, ibuf_len*7/8 + extra_samples*7/16);
# ifdef WMOPS_FX
move16( );
# endif
        prev_Q_hbana = Q_hbana;
#endif
```

The code provided above that may implement dynamic normalization applied to the high band analysis filterbank calls various functions. The functions called by the above code may be as follows:

```
Word16 normalize_hb_ana (Word16 *wb_in_ptr, STATE_ANA_HB_fx
&S_ana_hb_fx, Word16 prev_Q_hbana, Word16 len)
{
        Word16 max_a16=0;
        Word16 n_struc=15;
        Word16 n, k;
        Word16 Q_hbana=0;
        for(k=0,max_a16=0;k<len;k++)
          max_a16=MAX_FX(max_a16,abs_s(wb_in_ptr[k])); // max_s16 has the
sample with least sign bits
        n=norm_s(max_a16);
    #ifdef WMOPS_FX
    move16( );
    test( );
    move16( );
    #endif
        Q_hbana =(max_a16==0)?15:n;
        Q_hbana=sub(Q_hbana,3);//3 bits space for saturation
# if 0//added this patch to prevent saturation
        find_max_anahb_struc(&S_ana_hb_fx,&n_struc);
        if (sub(Q_hbana,prev_Q_hbana) > n_struc)
Q_hbana=add(prev_Q_hbana,n_struc); // Q_hbana lies in the interval
[Q_hbana,n_struc+prev_Q_hbana]
# endif
# if 1//added this patch to prevent saturation
        find_max_anahb_struc(&S_ana_hb_fx,&n_struc);
        if (sub(Q_hbana,prev_Q_hbana) > n_struc)
Q_hbana=add(prev_Q_hbana,n_struc); // Q_hbana lies in the interval
[Q_hbana,n_struc+prev_Q_hbana]
# endif
        for(k=0;k<len;k++)
          wb_in_ptr[k]= shl(wb_in_ptr[k],Q_hbana);
        // func. which brings the Qfac of states inside syn_hb_fx struct struc
        // to line up with curr frame's Qfac
        Q_factor_adjust_anahb(&S_ana_hb_fx,Q_hbana-prev_Q_hbana);
        return (Q_hbana);
}
void scale_hb_ana (Word16 *hb_out_ptr, Word16 *wb_14k_ptr, Word16 Q_hbana,
Word16 len)
{
  Word16 k;
#define BUG_FIX 0
#if BUG_FIX
  for(k=0;k<len;k++){
```

-continued

```
  hb__out__ptr[k]= shr(hb__out__ptr[k],Q__hbana);
 }
 for(k=0;k<2*len;k++){
  wb__14k__ptr[k]= shr(wb__14k__ptr[k],Q__hbana);
 }
#else
 for(k=0;k<len;k++){
  hb__out__ptr[k]= shr(hb__out__ptr[k],Q__hbana);
  wb__14k__ptr[k]= shr(wb__14k__ptr[k],Q__hbana);
 }
#endif
}
void Q__factor__adjust__anahb(struct STATE__ANA__HB__fx *f,Word16 shl__fac)
{
 Word16 i;
 for(i=0;i<2*ALLPASSSECTIONS;i++)
  f->state__ana__filt__hb__1__fx[i] = shl(f->state__ana__filt__hb__1__fx[i],shl__fac);
 for(i=0;i<LEN__DN__HB-2;i++)
  f->state__ana__filt__hb__2__fx[i] = shl(f->state__ana__filt__hb__2__fx[i],shl__fac);
 for(i=0;i<2*ALLPASSSECTIONS__STEEP+1;i++)
  f->state__ana__filt__hb__3__fx[i] = shl(f->state__ana__filt__hb__3__fx[i],shl__fac);
 for(i=0;i<2*ALLPASSSECTIONS__STEEP+1; i++)
  f->state__ana__filt__hb__4__fx[i] = shl(f->state__ana__filt__hb__4__fx[i],shl__fac);
  f->mem__ana__filt__hb__iir__fx[0] = L__shl(f->mem__ana__filt__hb__iir__fx[0],shl__fac);
}
void find__max__anahb__struc(struct STATE__ANA__HB__fx *f,Word16 *struc__norm)
{
 Word16 i;
 Word16 max=0;
 Word16 n,n1;
 for(i=0;i<2*ALLPASSSECTIONS;i++)
  max=MAX__FX(abs__s(f->state__ana__filt__hb__1__fx[i]),max);
 for(i=0;i<LEN__DN__HB-2;i++)
  max=MAX__FX(abs__s(f->state__ana__filt__hb__2__fx[i]),max);
 for(i=0;i<2*ALLPASSSECTIONS__STEEP+1;i++)
  max=MAX__FX(abs__s(f->state__ana__filt__hb__3__fx[i]),max);
 for(i=0;i<2*ALLPASSSECTIONS__STEEP+1; i++)
  max=MAX__FX(abs__s(f->state__ana__filt__hb__4__fx[i]),max);
 n=norm__s(max);
 n =(max==0)?15:n;
 n1=norm__1(f->mem__ana__filt__hb__iir__fx[0]);
 n1 =(f->mem__ana__filt__hb__iir__fx[0]==0)?31:n1;
 *struc__norm = sub(MIN__FX(n,n1),3); //3 bit head room
}
```

3GPP2 C.S0014-C, Version 0.3 Published July 2006 Section 5.13 "Decoding of Synthesis Filterbank for 16 KHz Decoding for SO 70"

Dynamic normalization may be implemented to the synthesis filterbank at the decoder. An example of source code to implement dynamic normalization applied to the synthesis filterbank at the decoder in accordance with section 5.13 of the 3GPP2 C.S0014-C standard may be as follows:

```
#ifdef USE__NORM__FOR__SYN__HB
   Word16 max__s16=0;
   Word16 n;
   Word16 n__struc=15;
   Word16 Q__hbsyn=0;
   static Word16 prev__Q__hbsyn=0;
 for(k=0,max__s16=0;k<140;k++)
   max__s16=MAX__FX(max__s16,abs__s(buf__HB__out__fx[k]));
//     max__s16 has the sample with least sign bits
 n=norm__s(max__s16);
 Q__hbsyn =(max__s16==0)?15:n;
 Q__hbsyn=sub(Q__hbsyn,3);//3 bits space for saturation
#if 1//added this patch to prevent saturation
 find__max__synhb__struc(&S__syn__hb__fx,&n__struc);
 if (sub(Q__hbsyn,prev__Q__hbsyn) > n__struc)
Q__hbsyn=add(prev__Q__hbsyn,n__struc); // Q__hbsyn
lies in the interval [Q__hbsyn,n__struc+prev__Q__hbsyn]
#endif
 for(k=0;k<UB__FRAMESIZE;k++)
```

-continued

```
  buf__HB__out__fx[k]= shl(buf__HB__out__fx[k],Q__hbsyn); //Q__lbexct
 // func. which brings the Qfac of states inside syn__hb__fx struct struc
 // to line up with curr frame's Qfac
 Q__factor__adjust__hb(&S__syn__hb__fx,Q__hbsyn-prev__Q__hbsyn);
#endif
#ifdef USE__NORM__FOR__SYN__HB
        //do shr and wrap prevQ to Q
#ifdef VOIP__DORA
        for(k=0;k<2*160;k++)
#else
        for(k=0;k<2*obuf__len;k++)
#endif
  buf__16fx[k]= shr(buf__16fx[k],Q__hbsyn); //Q__lbexct
  prev__Q__hbsyn= Q__hbsyn;
#endif
```

The code provided above that may implement dynamic normalization applied to the synthesis filterbank at the decoder calls various functions. The functions called by the above code may be as follows:

```
void Q_factor_adjust_hb(struct STATE_SYN_HB_fx *f,Word16 shl_fac)
{
 Word16 i;
 for(i=0;i<2*ALLPASSSECTIONS_STEEP;i++)
  f->state_syn_filt_hb_0_fx[i] = shl(f->state_syn_filt_hb_0_fx[i],shl_fac);
 for(i=0;i<2*ALLPASSSECTIONS_STEEP;i++)
  f->state_syn_filt_hb_1_fx[i] = shl(f->state_syn_filt_hb_1_fx[i],shl_fac);
 for(i=0;i<LEN_UP_HB;i++)
  f->state_syn_filt_hb_2_fx[i] = shl(f->state_syn_filt_hb_2_fx[i],shl_fac);
 for(i=0;i<2*ALLPASSSECTIONS+1;i++)
  f->state_syn_filt_hb_3_fx[i] = shl(f->state_syn_filt_hb_3_fx[i],shl_fac);
 for(i=0;i<2;i++)
  f->mem_syn_filt_hb_iir1_fx[i] = L_shl(f->mem_syn_filt_hb_iir1_fx[i],shl_fac);
 for(i=0;i<2;i++)
  f->mem_syn_filt_hb_iir2_fx[i] = L_shl(f->mem_syn_filt_hb_iir2_fx[i],shl_fac);
}
void find_max_synhb_struc(struct STATE_SYN_HB_fx *f,Word16 *struc_norm)
{
 Word16 i;
 Word16 max=0;
 Word32 max32=0,temp=0;
 Word16 n,n1;
 for(i=0;i<2*ALLPASSSECTIONS_STEEP;i++)
  max=MAX_FX(abs_s(f->state_syn_filt_hb_0_fx[i]),max);
 for(i=0;i<2*ALLPASSSECTIONS_STEEP;i++)
  max=MAX_FX(abs_s(f->state_syn_filt_hb_1_fx[i]),max);
 for(i=0;i<LEN_UP_HB;i++)
  max=MAX_FX(abs_s(f->state_syn_filt_hb_2_fx[i]),max);
 for(i=0;i<2*ALLPASSSECTIONS+1;i++)
  max=MAX_FX(abs_s(f->state_syn_filt_hb_3_fx[i]),max);
 for(i=0;i<2;i++)
  {
   if (f->mem_syn_filt_hb_iir1_fx[i] < 0)
      temp = L_negate(f->mem_syn_filt_hb_iir1_fx[i]);
   else
      temp = f->mem_syn_filt_hb_iir1_fx[i];
   max32=MAX_FX(temp,max32);
  }
for(i=0;i<2;i++)
  {
   if (f->mem_syn_filt_hb_iir2_fx[i] < 0)
      temp = L_negate(f->mem_syn_filt_hb_iir2_fx[i]);
   else
      temp = f->mem_syn_filt_hb_iir2_fx[i];
   max32=MAX_FX(temp,max32);
  }
 n=norm_s(max);
 n =(max==0)?15:n;
 n1=norm_l(max32);
 n1 =(max32==0)?31:n1;
 *struc_norm = sub(MIN_FX(n,n1),3); //1 bit head room
}
```

Figure 5:
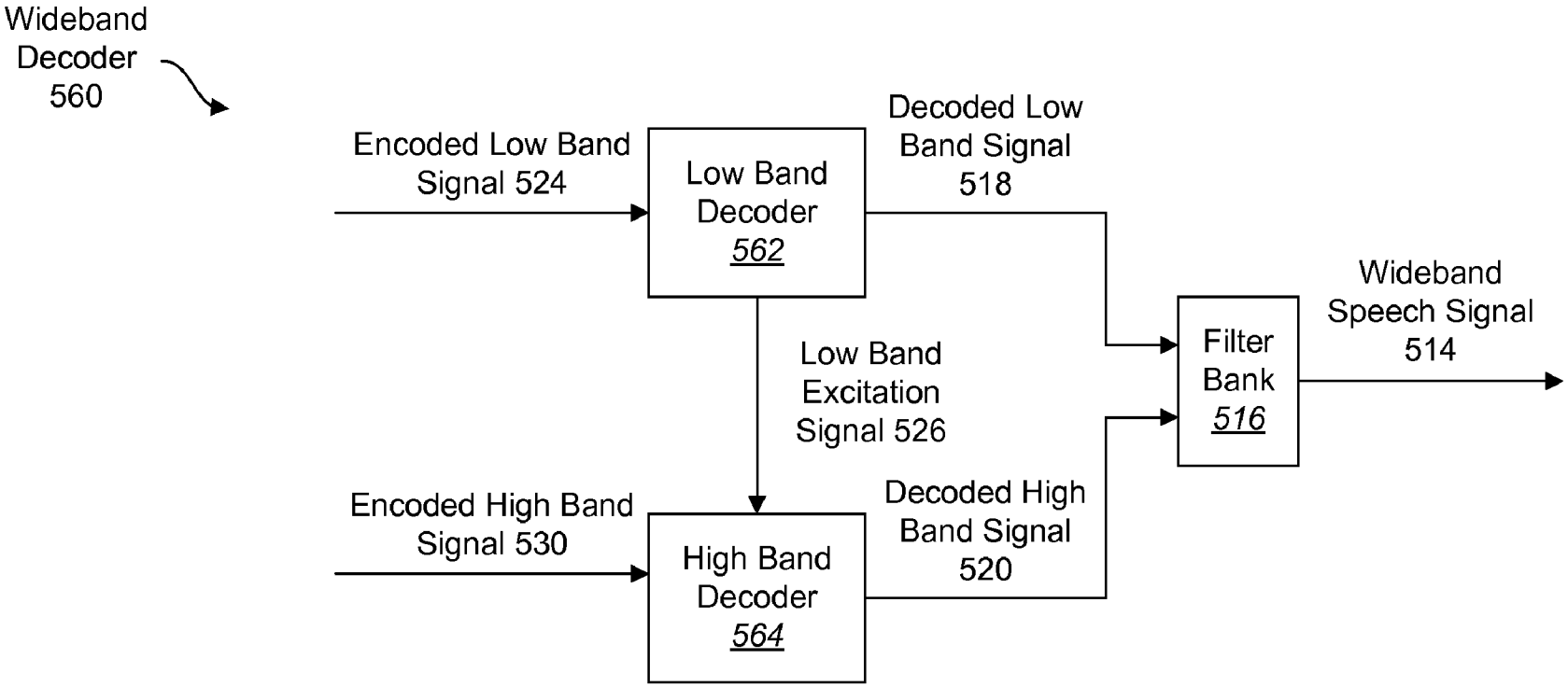
FIG. 5 illustrates a wideband decoder that may be utilized in a wireless communication system.

FIG. 5 illustrates a wideband decoder 560. The wideband decoder 560 may be implemented in an apparatus that may be utilized within a wireless communication system 100. The apparatus may be a mobile phone, a personal digital assistant (PDA), a laptop computer, a digital camera, a music player, a game device, or any other device with a processor. The apparatus may function as a mobile station 102 or a base station 104 within a wireless communication system 100.

An encoded low band signal 524 (or 224) may be provided to the wideband decoder 560. The wideband decoder 560 may include a low band decoder 562. The low band decoder 562 may decode the encoded low band signal 524, thereby obtaining a decoded low band signal 518. The low band decoder 562 may also output a low band excitation signal 526.

An encoded high band signal 530 (or 230) may also be provided to the wideband decoder 560. The wideband decoder 560 may include a high band decoder 564. The encoded high band signal 530 may be provided to the high band decoder 564. The low band excitation signal 526 that is output by the low band decoder 562 may also be provided to the high band decoder 564. The high band decoder 564 may decode the encoded high band signal 530 according to information in the low band excitation signal 526, thereby obtaining a decoded high band signal 520.

The wideband decoder 560 may also include a synthesis filter bank 516. The decoded low band signal 518 that is output by the low band decoder 562 and the decoded high band signal 520 that is output by the high band decoder 564 may be provided to the synthesis filter bank 516. The synthesis filter bank 516 may combine the decoded low band signal 518 and the decoded high band signal 520 to produce a wideband speech signal 514.

The high band decoder 564 may include some of the identical components that were described above in connection with the high band encoder 228. For example, the high band decoder 564 may include the high band excitation generator 332, the signal normalizer 338, the filter states normalization factor adjuster 340, and the factor determination component 346. (These components are not shown in FIG. 5.) The operation of these components may be similar or identical to the operation of the corresponding components that were described above in relation to the high band encoder 228.

Thus, the techniques described above for dynamic normalization of the low band excitation signal 226 in the context of a wideband encoder 212 may also be applied to the low band excitation signal 526 that is shown in FIG. 5 in the context of a wideband decoder 560.

Figure 6:
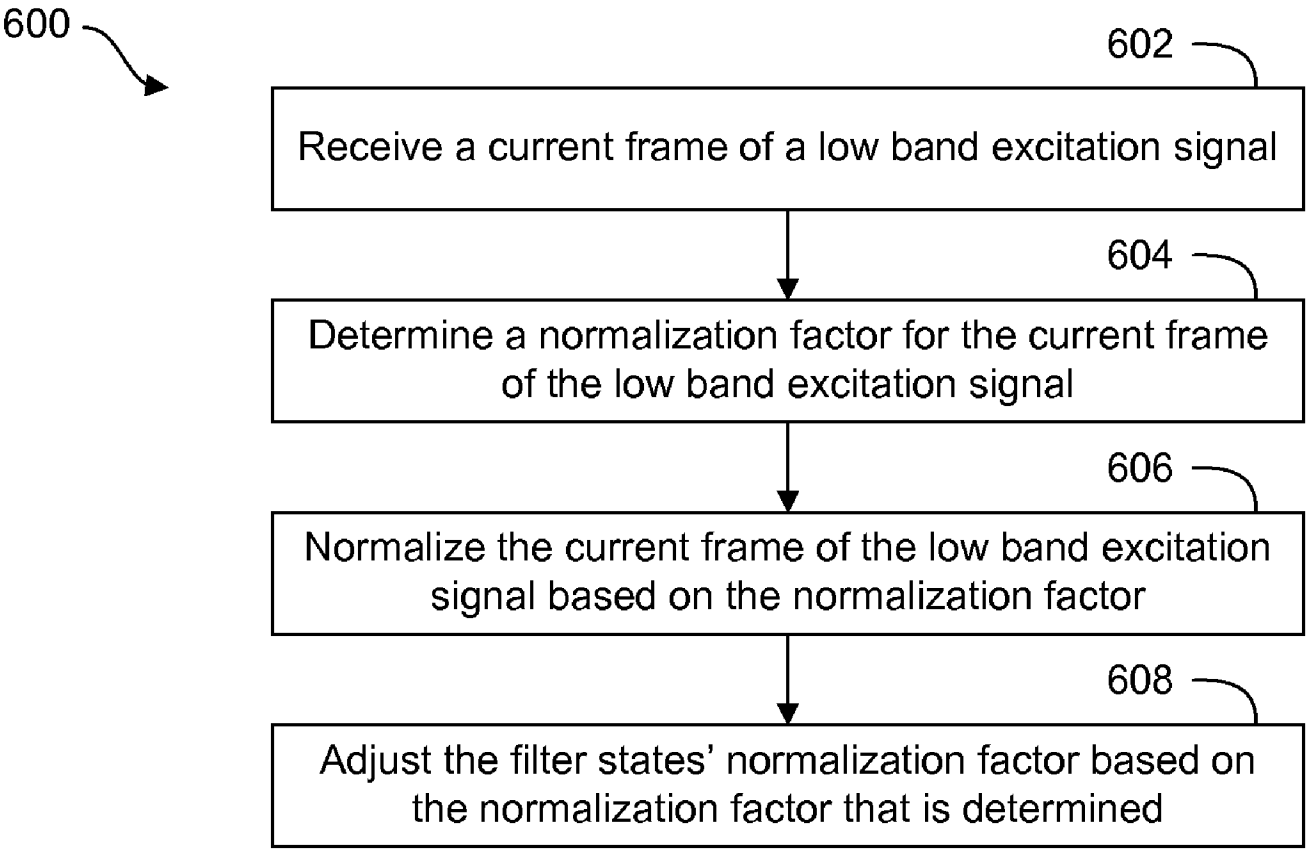
FIG. 6 illustrates a method for dynamic normalization to reduce loss in precision for low-level signals.

FIG. 6 illustrates a method 600 for dynamic normalization to reduce loss in precision for low-level signals. The method 600 may be implemented by a wideband encoder 212 within a mobile station 102 or a base station 104 within a wireless communication system 100. Alternatively, the method 600 may be implemented by a wideband decoder 560 within a mobile station 102 or a base station 104 within a wireless communication system 100.

In accordance with the method 600, a current frame of a low band excitation signal 226 may be received 602. A normalization factor 344 for the current frame of the low band excitation signal 226 may be determined 604. The normalization factor 344 may depend on the amplitude of the current frame of the low band excitation signal 226. The normalization factor 344 may also depend on the values of filter states 342 of a high band excitation generator 332 after filtering operations were performed on a previous frame of a normalized low band excitation signal 336.

The current frame of the low band excitation signal 226 may be normalized 606 based on the normalization factor 344 that is determined 604. In addition, the normalization factor of the filter states of the high band excitation generator 332 may be adjusted 608 based on the normalization factor 344 that is determined 604.

Figure 7:
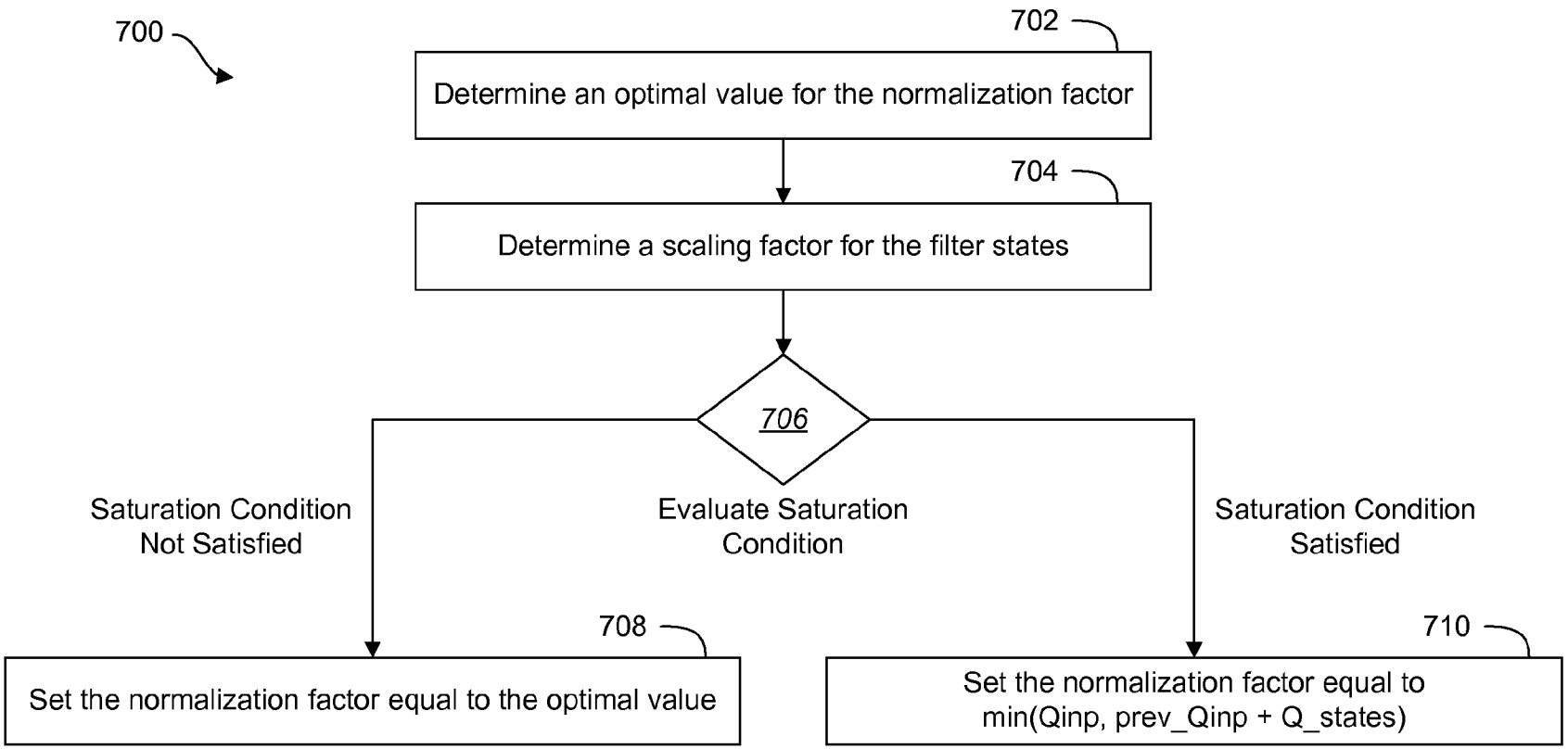
FIG. 7 illustrates a method for determining a normalization factor for a current frame of a low band excitation signal.

FIG. 7 illustrates a method 700 for determining a normalization factor 344*a* for the current frame of the low band excitation signal 226. (The reference number 344*a* refers to the normalization factor 344*a* for the current frame, and the reference number 344*b* refers to the normalization factor 344*b* for the previous frame.) The method 700 may be implemented by a wideband encoder 212 within a mobile station 102 or a base station 104 within a wireless communication system 100. Alternatively, the method 700 may be implemented by a wideband decoder 560 within a mobile station 102 or a base station 104 within a wireless communication system 100.

In accordance with the method 700, an optimal value 450 for the normalization factor 344*a* for the current frame of the low band excitation signal 226 may be determined 702. The optimal value 450 for the normalization factor 344*a* may indicate to what extent the bits of the current frame of the low band excitation signal 226 may be left-shifted without causing saturation.

A scaling factor 454 for the filter states 342 of the high band excitation generator 332 may be determined 704. The scaling factor 454 may indicate to what extent the bits of the filter states 342 may be left-shifted without causing saturation.

A saturation condition may be evaluated 706. The saturation condition may depend on the optimal value 450 for the normalization factor 344*a* for the current frame of the low band excitation signal 226. The saturation condition may also depend on the scaling factor 454 for the filter states 342 of the high band excitation generator 332. The saturation condition may also depend on the normalization factor 344*b* for the previous frame of the low band excitation signal 226.

If it is determined 706 that the saturation condition is not satisfied, this may be interpreted to mean that setting the normalization factor 344 equal to the optimal value 450 that was determined 702 is not going to cause saturation. Accordingly, the normalization factor 344 for the current frame of the low band excitation signal 226 may be set 708 equal to the optimal value 450 that was determined 702.

If it is determined 706 that the saturation condition is satisfied, this may be interpreted to mean that setting the normalization factor 344 equal to the optimal value 450 that was determined 702 is going to cause saturation. Accordingly, the normalization factor 344*a* for the current frame of the low band excitation signal 226 may be set 710 equal to prev_Qinp+Q_states. As discussed above, the term prev_Qinp may refer to the normalization factor 344*b* for the previous frame of the low band excitation signal 226. The term Q_states may refer to the scaling factor for the filter states 342.

Figure 8:
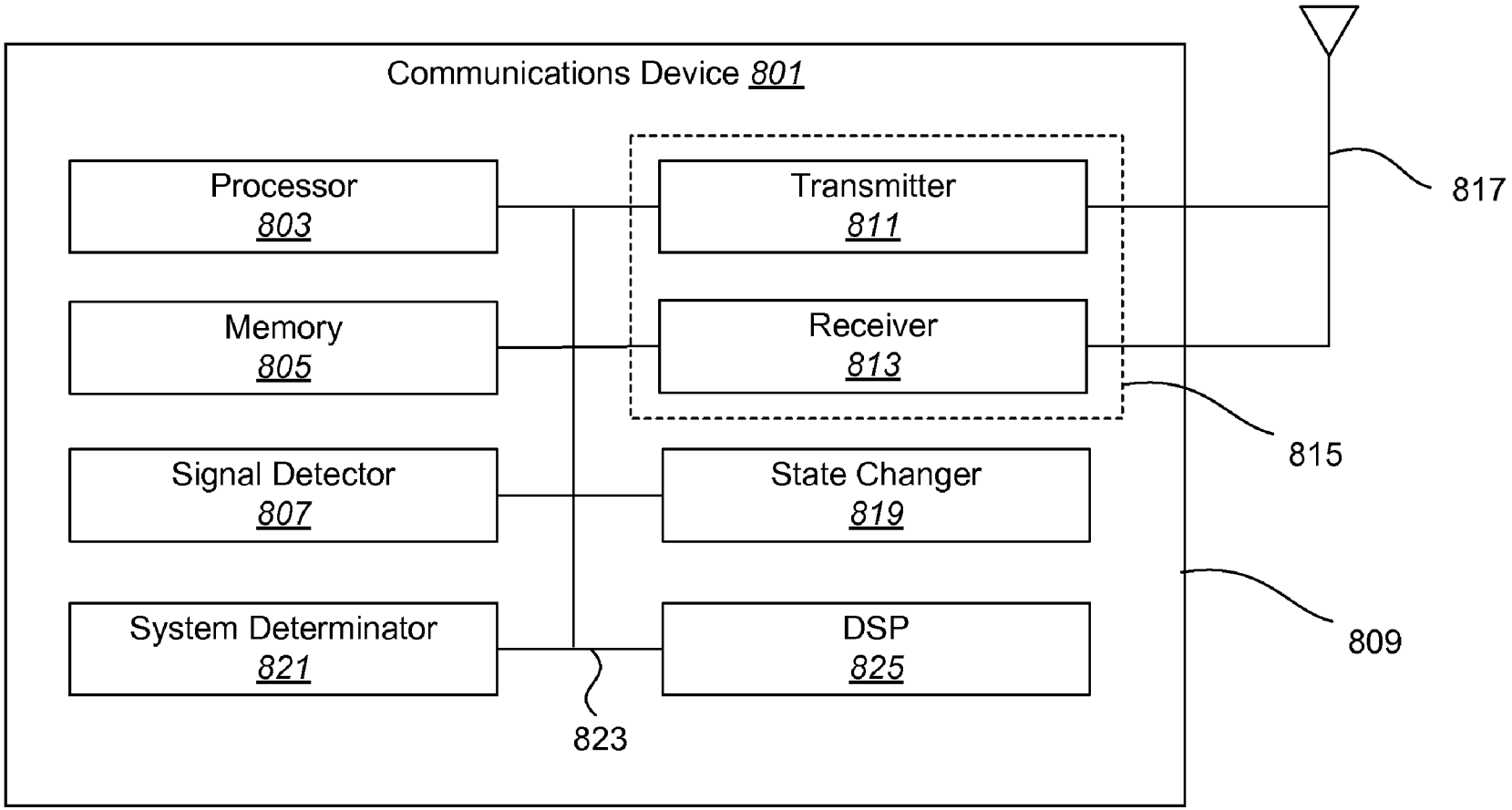
FIG. 8 illustrates various components that may be utilized in a communications device.

FIG. 8 illustrates various components that may be utilized in a communications device 801. The communications device 801 may include a processor 803 which controls operation of the device 801. The processor 803 may also be referred to as a CPU. Memory 805, which may include both read-only memory (ROM) and random access memory (RAM), provides instructions and data to the processor 803. A portion of the memory 805 may also include non-volatile random access memory (NVRAM).

The communications device 801 may also include a housing 809 that may include a transmitter 811 and a receiver 813 to allow transmission and reception of data between the communications device 801 and a remote location. The transmitter 811 and receiver 813 may be combined into a transceiver 815. An antenna 817 may be attached to the housing 809 and electrically coupled to the transceiver 815.

The communications device 801 may also include a signal detector 807 that may be used to detect and quantify the level of signals received by the transceiver 815. The signal detector 807 may detect such signals as total energy, pilot energy per pseudonoise (PN) chips, power spectral density, and other signals.

A state changer 819 of the communications device 801 may control the state of the communications device 801 based on a current state and additional signals received by the transceiver 815 and detected by the signal detector 807. The device 801 may be capable of operating in any one of a number of states. The communications device 801 may also include a system determinator 821 that may be used to control the device 801 and to determine which service provider system the device 801 should transfer to when it determines the current service provider system is inadequate.

The various components of the communications device 801 may be coupled together by a bus system 823 which may include a power bus, a control signal bus, and a status signal bus in addition to a data bus. However, for the sake of clarity, the various busses are illustrated in FIG. 8 as the bus system 823. The communications device 801 may also include a digital signal processor (DSP) 825 for use in processing signals.

Information and signals may be represented using any of a variety of different technologies and techniques. For example, data, instructions, commands, information, signals and the like that may be referenced throughout the above description may be represented by voltages, currents, electromagnetic waves, magnetic fields or particles, optical fields or particles or any combination thereof.

The various illustrative logical blocks, modules, circuits, methods, and algorithm steps disclosed herein may be implemented in hardware, software, or both. To clearly illustrate this interchangeability of hardware and software, various illustrative components, blocks, modules, circuits and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as limiting the scope of the claims.

The various illustrative logical blocks, modules and circuits described above may be implemented or performed with a general purpose processor, a digital signal processor (DSP), an application specific integrated circuit (ASIC), a field programmable gate array signal (FPGA) or other programmable logic device, discrete gate or transistor logic, discrete hardware components or any combination thereof designed to perform the functions described herein. A general purpose processor may be a microprocessor, but in the alternative, the processor may be a controller, microcontroller or state machine. A processor may also be implemented as a combination of computing devices, e.g., a combination of a DSP and a microprocessor, a plurality of microprocessors, one or more microprocessors in conjunction with a DSP core or any other such configuration.

The methods disclosed herein may be implemented in hardware, in software, or both. Software may reside in any form of storage medium that is known in the art. Some examples of storage media that may be used include RAM memory, flash memory, ROM memory, EPROM memory, EEPROM memory, registers, a hard disk, a removable disk, an optical disk, and so forth. Software may comprise a single instruction, or many instructions, and may be distributed over several different code segments, among different programs and across multiple storage media. A storage medium may be coupled to a processor such that the processor can read information from, and write information to, the storage medium. In the alternative, the storage medium may be integral to the processor.

The methods disclosed herein may comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

While specific features, aspects, and configurations have been illustrated and described, it is to be understood that the claims are not limited to the precise configuration and components illustrated above. Various modifications, changes, and variations may be made in the arrangement, operation and details of the features, aspects, and configurations described above without departing from the scope of the claims.

What is claimed is:

1. An apparatus that is configured for dynamic normalization to reduce loss in precision for low-level signals, comprising:

a processor;

memory in electronic communication with the processor; and instructions stored in the memory, the instructions being executable to:

determine a normalization factor for a current frame of a signal, wherein the normalization factor depends on an amplitude of the current frame of the signal, and wherein the normalization factor also depends on values of filter states after one or more operations were performed on a previous frame of a normalized signal, and wherein the normalization factor also depends on a normalization factor for the previous frame;

normalize the current frame of the signal based on the normalization factor that is determined; and adjust the states' normalization factor based on the normalization factor that is determined.

2. The apparatus of claim 1, wherein the values are squared values.

3. The apparatus of claim 1, wherein the values are cubic values.

4. The apparatus of claim 1, wherein the normalization factor is selected so that saturation does not occur.

5. The apparatus of claim 1, wherein the apparatus is a handset.

6. The apparatus of claim 5, wherein the apparatus is a handset implementing wireless communications.

7. The apparatus of claim 1, wherein the apparatus is a base station.

8. The apparatus of claim 1, wherein the signal is a low band excitation signal, wherein the normalized signal is a normalized low band excitation signal, wherein the states are filter states of a synthesis filter, and where the synthesis filter derives an output synthesized speech signal from the normalized low band excitation signal.

9. The apparatus of claim 1, wherein the signal is a low band excitation signal, wherein the normalized signal is a normalized low band excitation signal, wherein the states are filter states of high-band excitation generator, and wherein the high-band excitation generator derives a high-band excitation signal from the normalized low band excitation signal.

10. The apparatus of claim 1, wherein the signal is an input speech signal, wherein the normalized signal is a normalized input speech signal, wherein the states are filter states of an analysis filterbank, and wherein the analysis filterbank derives an output signal from the normalized input speech signal.

11. The apparatus of claim 1, wherein the signal is a high band excitation signal, wherein the normalized signal is a normalized high band signal, wherein the states are filter states of a synthesis filterbank, and wherein the synthesis filterbank derives an output signal from the normalized high band signal.

12. A method for dynamic normalization to reduce loss in precision for low-level signals, comprising:

determining a normalization factor for a current frame of a signal, wherein the normalization factor depends on an amplitude of the current frame of the signal, and wherein the normalization factor also depends on values of filter states after one or more operations were performed on a previous frame of a normalized signal, and wherein the normalization factor also depends on a normalization factor for the previous frame;

normalizing the current frame of the signal based on the normalization factor that is determined; and adjusting the states' normalization factor based on the normalization factor that is determined.

13. The method of claim 12, wherein the values are squared values.

14. The method of claim 12, wherein the values are cubic values.

15. The method of claim 12, wherein the normalization factor is selected so that saturation does not occur.

16. The method of claim 12, wherein the signal is a low band excitation signal, wherein the normalized signal is a normalized low band excitation signal, wherein the states are filter states of a synthesis filter, and where the synthesis filter derives an output synthesized speech signal from the normalized low band excitation signal.

17. The method of claim 12, wherein the signal is a low band excitation signal, wherein the normalized signal is a normalized low band excitation signal, wherein the states are filter states of high-band excitation generator, and wherein the high-band excitation generator derives a high-band excitation signal from the normalized low band excitation signal.

18. The method of claim 12, wherein the signal is an input speech signal, wherein the normalized signal is a normalized input speech signal, wherein the states are filter states of an analysis filterbank, and wherein the analysis filterbank derives an output signal from the normalized input speech signal.

19. The method of claim 12, wherein the signal is a high band signal, wherein the normalized signal is a normalized high band signal, wherein the states are filter states of a synthesis filterbank, and wherein the synthesis filterbank derives an output signal from the normalized high band signal.

20. An apparatus that is configured for dynamic normalization to reduce loss in precision for low-level signals, comprising:

means for determining a normalization factor for a current frame of a signal, wherein the normalization factor depends on an amplitude of the current frame of the signal, and wherein the normalization factor also depends on values of filter states after one or more operations were performed on a previous frame of a normalized signal, and wherein the normalization factor also depends on a normalization factor for the previous frame;

means for normalizing the current frame of the signal based on the normalization factor that is determined; and means for adjusting the states' normalization factor based on the normalization factor that is determined.

21. The apparatus of claim 20, wherein the non linear values are squared values.

22. The apparatus of claim 20, wherein the non linear values are cubic values.

23. The apparatus of claim 20, wherein the normalization factor is selected so that saturation does not occur.

24. The apparatus of claim 20, wherein the apparatus is a handset.

25. The apparatus of claim 24, wherein the apparatus is a handset implementing wireless communications.

26. The apparatus of claim 20, wherein the apparatus is a base station.

27. The apparatus of claim 20, wherein the signal is a low band excitation signal, wherein the normalized signal is a normalized low band excitation signal, wherein the states are filter states of a synthesis filter, and where the synthesis filter derives an output synthesized speech signal from the normalized low band excitation signal.

28. The apparatus of claim 20, wherein the signal is a low band excitation signal, wherein the normalized signal is a normalized low band excitation signal, wherein the states are filter states of high-band excitation generator, and wherein the high-band excitation generator derives a high-band excitation signal from the normalized low band excitation signal.

29. The apparatus of claim 20, wherein the signal is an input speech signal, wherein the normalized signal is a normalized input speech signal, wherein the states are filter states of an analysis filterbank, and wherein the analysis filterbank derives an output signal from the normalized input speech signal.

30. The apparatus of claim 20, wherein the signal is a high band excitation signal, wherein the normalized signal is a normalized high band signal, wherein the states are filter states of a synthesis filterbank, and wherein the synthesis filterbank derives an output signal from the normalized high band signal.

31. A computer-readable medium configured to store a set of instructions executable to:

determine a normalization factor for a current frame of a signal, wherein the normalization factor depends on an amplitude of the current frame of the signal, and wherein the normalization factor also depends on values of filter states after one or more operations were performed on a previous frame of a normalized signal, and wherein the normalization factor also depends on a normalization factor for the previous frame;

normalize the current frame of the signal based on the normalization factor that is determined; and adjust the states' normalization factor based on the normalization factor that is determined.

32. The computer-readable medium of claim 31, wherein the values are squared values.

33. The computer-readable medium of claim 31, wherein the values are cubic values.

34. The computer-readable medium of claim 31, wherein the normalization factor is selected so that saturation does not occur.

35. The computer-readable medium of claim 31, wherein the signal is a low band excitation signal, wherein the normalized signal is a normalized low band excitation signal, wherein the states are filter states of a synthesis filter, and where the synthesis filter derives an output synthesized speech signal from the normalized low band excitation signal.

36. The computer-readable medium of claim 31, wherein the signal is a low band excitation signal, wherein the normalized signal is a normalized low band excitation signal, wherein the states are filter states of high-band excitation generator, and wherein the high-band excitation generator derives a high-band excitation signal from the normalized low band excitation signal.

37. The computer-readable medium of claim 31, wherein the signal is an input speech signal, wherein the normalized signal is a normalized input speech signal, wherein the states are filter states of an analysis filterbank, and wherein the analysis filterbank derives an output signal from the normalized input speech signal.

38. The computer-readable medium of claim 31, wherein the signal is a high band excitation signal, wherein the normalized signal is a normalized high band signal, wherein the states are filter states of a synthesis filterbank, and wherein the synthesis filterbank derives an output signal from the normalized high band signal.

39. An apparatus that is configured for dynamic normalization to reduce loss in precision for low-level signals, comprising:

a processor;

memory in electronic communication with the processor; and instructions stored in the memory, the instructions being executable to:

determine a first gain of a first frame, wherein the first frame is a current frame;

determine a second gain of a second frame, wherein the second frame is a previous frame;

derive a number of bits corresponding to the first gain and the second gain; and subtract the number of bits corresponding to a maximum of the first gain and the second gain from a normalization factor associated with the first frame, wherein the normalization factor depends on an amplitude of the current frame of the signal, and wherein the normalization factor also depends on values of filter states after one or more operations were performed on a previous frame of a normalized signal, and wherein the normalization factor also depends on a normalization factor for the previous frame.

40. The apparatus of claim 39, wherein the first gain and the second gain are a linear predictive coding (LPC) gain.

41. The apparatus of claim 39, wherein the apparatus is a handset.

42. The apparatus of claim 39, wherein the number of bits corresponding to the first gain and the second gain is derived using a mapping schema.

43. A method for dynamic normalization to reduce loss in precision for low-level signals, comprising:

determining a first gain of a first frame, wherein the first frame is a current frame;

determining a second gain of a second frame, wherein the second frame is a previous frame;

deriving a number of bits corresponding to the first gain and the second gain; and subtracting the number of bits corresponding to a maximum of the first gain and the second gain from a normalization factor associated with the first frame, wherein the normalization factor depends on an amplitude of the current frame of the signal, and wherein the normalization factor also depends on values of filter states after one or more operations were performed on a previous frame of a normalized signal, and wherein the normalization factor also depends on a normalization factor for the previous frame.

44. The method of claim 43, wherein the first gain and the second gain are a linear predictive coding (LPC) gain.

45. The method of claim 43, wherein the method is implemented by a handset.

46. The method of claim 43, wherein the number of bits corresponding to the first gain and the second gain is derived using a mapping schema.

47. An apparatus that is configured for dynamic normalization to reduce loss in precision for low-level signals, comprising:

means for determining a first gain of a first frame, wherein the first frame is a current frame;

means for determining a second gain of a second frame, wherein the second frame is a previous frame;

means for deriving a number of bits corresponding to the first gain and the second gain; and means for subtracting the number of bits corresponding to a maximum of the first gain and the second gain from a normalization factor associated with the first frame, wherein the normalization factor depends on an amplitude of the current frame of the signal, and wherein the normalization factor also depends on values of filter states after one or more operations were performed on a previous frame of a normalized signal, and wherein the normalization factor also depends on a normalization factor for the previous frame.

48. The apparatus of claim 47, wherein the first gain and the second gain are a linear predictive coding (LPC) gain.

49. The apparatus of claim 47, wherein the apparatus is a handset.

50. The apparatus of claim 47, wherein the number of bits corresponding to the first gain and the second gain is derived using a mapping schema.

51. A computer-readable medium configured to store a set of instructions executable to:

determine a first gain of a first frame, wherein the first frame is a current frame;

determine a second gain of a second frame, wherein the second frame is a previous frame;

derive a number of bits corresponding to the first gain and the second gain; and subtract the number of bits corresponding to a maximum of the first gain and the second gain from a normalization factor associated with the first frame, wherein the normalization factor depends on an amplitude of the current frame of the signal, and wherein the normalization factor also depends on values of filter states after one or more operations were performed on a previous frame of a normalized signal, and wherein the normalization factor also depends on a normalization factor for the previous frame.

52. The computer-readable medium of claim 51, wherein the first gain and the second gain are a linear predictive coding (LPC) gain.

53. The computer-readable medium of claim 51, wherein the number of bits corresponding to the first gain and the second gain is derived using a mapping schema.

* * * * *